US011208787B2

(12) United States Patent
Hagiwara et al.

(10) Patent No.: US 11,208,787 B2
(45) Date of Patent: Dec. 28, 2021

(54) HYDRAULIC DRIVE SYSTEM FOR WORK MACHINE

(71) Applicant: Hitachi Construction Machinery Co., Ltd., Tokyo (JP)

(72) Inventors: Masayuki Hagiwara, Chichibu (JP); Katsuaki Kodaka, Tsukuba (JP); Mitsuhiko Kanehama, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/958,516

(22) PCT Filed: Dec. 25, 2018

(86) PCT No.: PCT/JP2018/047649
§ 371 (c)(1),
(2) Date: Jun. 26, 2020

(87) PCT Pub. No.: WO2019/131674
PCT Pub. Date: Jul. 4, 2019

(65) Prior Publication Data

US 2021/0054592 A1 Feb. 25, 2021

(30) Foreign Application Priority Data

Dec. 28, 2017 (JP) ..... JP2017-254730

(51) Int. Cl.
*E02F 9/22* (2006.01)
*F15B 11/17* (2006.01)
*E02F 3/42* (2006.01)

(52) U.S. Cl.
CPC ..... *E02F 9/2242* (2013.01); *E02F 9/2232* (2013.01); *E02F 9/2292* (2013.01);
(Continued)

(58) Field of Classification Search
None
See application file for complete search history.

(56) References Cited

U.S. PATENT DOCUMENTS 7,665,299 B2 * 2/2010 Schuh ..... E02F 9/2246 60/430
9,341,198 B2 * 5/2016 Nakamura ..... F15B 15/20
(Continued)

FOREIGN PATENT DOCUMENTS

JP 58-146634 A 9/1983
JP 4-49196 A 2/1992
(Continued)

OTHER PUBLICATIONS

International Search Report (PCT/ISA/210) issued in PCT Application No. PCT/JP2018/047649 dated Apr. 2, 2019 with English translation (three (3) pages).
(Continued)

*Primary Examiner* — Thomas E Lazo
*Assistant Examiner* — Michael Quandt
(74) *Attorney, Agent, or Firm* — Crowell & Moring LLP

(57) ABSTRACT

A hydraulic drive system includes a swing directional control valve 81 and a third boom directional control valve 82 that are connected to a third hydraulic pump 33. Furthermore, the hydraulic drive system includes: a second auxiliary directional control valve 84 that is connected to the third hydraulic pump 33, and is connectable with a second special hydraulic actuator 64 for driving special attachments; and a first selector valve 96 that is connected to the third hydraulic
(Continued)

pump 33 upstream of the second auxiliary directional control valve 84, and is connectable with an additional hydraulic pump 97. The first selector valve 96 switches the hydraulic fluid source of the second special hydraulic actuator 64 connected to the second auxiliary directional control valve 84 at least between the third hydraulic pump 33 and the additional hydraulic pump 97. Operability for combined operation of a special attachment can be improved in the hydraulic drive system equipped in advance with an auxiliary directional control valve that is connectable with an additional hydraulic actuator for driving the special attachment.

7 Claims, 7 Drawing Sheets

(52) U.S. Cl.
CPC ..... *E02F 9/2296* (2013.01); *E02F 3/422* (2013.01); *E02F 9/2282* (2013.01); *F15B 11/17* (2013.01); *F15B 2211/20538* (2013.01); *F15B 2211/20546* (2013.01); *F15B 2211/20576* (2013.01); *F15B 2211/31535* (2013.01); *F15B 2211/31547* (2013.01); *F15B 2211/31582* (2013.01); *F15B 2211/613* (2013.01); *F15B 2211/7142* (2013.01)

(56) References Cited

U.S. PATENT DOCUMENTS

| | | | | |
|---|---|---|---|---|
| 10,662,619 | B2 * | 5/2020 | Sakamoto ..... | F15B 11/0426 |
| 2014/0090369 | A1 | 4/2014 | Nakamura et al. | |
| 2016/0215481 | A1 | 7/2016 | Kawasaki et al. | |
| 2018/0187396 | A1 | 7/2018 | Sakamoto | |

FOREIGN PATENT DOCUMENTS

| | | | |
|---|---|---|---|
| JP | 2012-241803 | A | 12/2012 |
| JP | 2017-180562 | A | 10/2017 |
| WO | WO 2015/053094 | A1 | 4/2015 |
| WO | WO 2016/208349 | A1 | 12/2016 |

OTHER PUBLICATIONS

Japanese-language Written Opinion (PCT/ISA/237) issued in PCT Application No. PCT/JP2018/047649 dated Apr. 2, 2019 (four (4) pages).
International Preliminary Report on Patentability (PCT/IB/338 & PCT/IB/373) issued in PCT Application No. PCT/JP2018/047649 dated Jul. 9, 2020, including English translation of document C2 (Japanese-language Written Opinion (PCT/ISA/237) previously filed on Jun. 26, 2020) (seven (7) pages).
Extended European Search Report issued in European Application No. 18897439.8 dated Jul. 8, 2021 (nine (9) pages).

* cited by examiner

HYDRAULIC DRIVE SYSTEM FOR WORK MACHINE

TECHNICAL FIELD

The present invention relates to a hydraulic drive system for a work machine such as a hydraulic excavator, and relates to a hydraulic drive system that can drive special attachments as necessary.

BACKGROUND ART

A work machine such as a hydraulic excavator includes a hydraulic drive system including: a plurality of hydraulic actuators that drive work elements such as a boom and an arm; a plurality of hydraulic pumps as hydraulic fluid sources that supply a hydraulic fluid to those hydraulic actuators; and a plurality of directional control valves that control flows of the hydraulic fluid supplied from the hydraulic pumps to the hydraulic actuators. Thus, the work machine is configured to perform various types of operation by controlling the driving of the plurality of actuators using the plurality of directional control valves. There are some work machines to which special attachments which are one type of work elements can be attached when those special attachments are necessary. For such work machines, there are some hydraulic drive systems for work machines equipped in advance with an auxiliary directional control valve to which an additional hydraulic actuator for driving a special attachment can be connected, and which can control the flows of a hydraulic fluid supplied from hydraulic pumps to the additional hydraulic actuator, in addition to directional control valves for controlling permanently installed hydraulic actuators (see Patent Document 1, for example).

PRIOR ART DOCUMENT

Patent Document

Patent Document 1: JP-2012-241803-A

SUMMARY OF THE INVENTION

Problems to be Solved by the Invention

In a hydraulic drive system described in Patent Document 1, an auxiliary directional control valve that controls an additional hydraulic actuator for driving a special attachment, and directional control valves that control permanently installed hydraulic actuators are connected, in parallel with each other, to hydraulic pumps. Thus, the additional hydraulic actuator can be driven simultaneously with the permanently installed hydraulic actuators, and the special attachment can be operated in combination with operation of other work elements.

However, since, in the hydraulic drive system with the configuration described above, the additional hydraulic actuator and the permanently installed actuators are supplied with a hydraulic fluid from shared hydraulic fluid sources (hydraulic pumps), the driving of the individual hydraulic actuators is mutually affected by operation load pressures of the hydraulic actuators when combined operation of the work elements including the special attachment is performed. Accordingly, the hydraulic fluid supplied from the shared hydraulic fluid sources is preferentially supplied to hydraulic actuators other than the additional hydraulic actuator in some cases. In this case, the amount of supply of the hydraulic fluid to the additional hydraulic actuator becomes insufficient or unstable, and stable operation of the special attachment is not attained in some cases. That is, there is room for improvement in operability for combined operation in a case where a special attachment is attached.

For example, examples of special attachments having room for improvement in operability for combined operation include swing-type grapples having a grappling function and a swing function. In a case where a swing-type grapple is attached to the hydraulic drive system described in Patent Document 1, a grapple-swing hydraulic motor (hydraulic actuator) is connected to a second auxiliary directional control valve, for example. In such a configuration, in a case where swing operation of an upper swing structure, operation of a boom and an arm, swing operation of the grapple and the like are performed simultaneously, the swing of the grapple is not started in some cases until the operation of the upper swing structure, the boom or the arm ends. It is presumed that this is because the supply of the hydraulic fluid from the shared hydraulic fluid sources to the hydraulic actuators such as a swing hydraulic pump or a boom cylinder is prioritized, and the amount of supply of the hydraulic fluid to the grapple-swing hydraulic motor becomes insufficient or unstable.

The present invention has been made in order to overcome the problems described above, and an object thereof is to provide a hydraulic drive system for a work machine, that makes it possible to improve operability for combined operation of a special attachment in a hydraulic drive system equipped in advance with an auxiliary directional control valve that is connectable with an additional hydraulic actuator for driving the special attachment.

Means for Solving the Problem

The present application includes a plurality means for solving the problems described above, and one example thereof is a hydraulic drive system for a work machine, the hydraulic drive system including: a first hydraulic pump and a second hydraulic pump that supply a hydraulic fluid at least to a first hydraulic actuator and a second hydraulic actuator; a third hydraulic pump that supplies the hydraulic fluid at least to a third hydraulic actuator and the first hydraulic actuator; a first-hydraulic-actuator first directional control valve that controls a flow of the hydraulic fluid supplied from the first hydraulic pump to the first hydraulic actuator; a second-hydraulic-actuator second directional control valve that controls a flow of the hydraulic fluid supplied from the first hydraulic pump to the second hydraulic actuator; a first-hydraulic-actuator second directional control valve that controls a flow of the hydraulic fluid supplied from the second hydraulic pump to the first hydraulic actuator; a second-hydraulic-actuator first directional control valve that controls a flow of the hydraulic fluid supplied from the second hydraulic pump to the second hydraulic actuator; a first auxiliary directional control valve that is connectable with a first special hydraulic actuator for driving an additionally attachable special attachment, and is configured to control a flow of the hydraulic fluid supplied from the second hydraulic pump to the first special hydraulic actuator; a third-hydraulic-actuator directional control valve that controls a flow of the hydraulic fluid supplied from the third hydraulic pump to the third hydraulic actuator; and a first-hydraulic-actuator third directional control valve that controls a flow of the hydraulic fluid supplied from the third hydraulic pump to the first hydraulic actuator. In the hydraulic drive system for a work machine, the first-hydraulic-actuator first directional control valve and the second-hydraulic-actuator second directional control valve are connected, in parallel with each other, to the first hydraulic pump, the first-hydraulic-actuator second directional control valve, the second-hydraulic-actuator first directional control valve and the first auxiliary directional control valve are connected, in parallel with each other, to the second hydraulic pump, and the third-hydraulic-actuator directional control valve and the first-hydraulic-actuator third directional control valve are connected, in parallel with each other, to the third hydraulic pump. The hydraulic drive system includes: a second auxiliary directional control valve that is connected to the third hydraulic pump, is connectable with a second special hydraulic actuator for driving the special attachment or an additionally attachable special attachment different from the special attachment, and is configured to control a flow of the hydraulic fluid to the second special hydraulic actuator; and a selector valve that is connected to the third hydraulic pump upstream of the second auxiliary directional control valve, and is connectable with a retrofit additional hydraulic pump. The selector valve is configured to switch a hydraulic fluid source of the second special hydraulic actuator connected to the second auxiliary directional control valve at least between the third hydraulic pump and the additional hydraulic pump.

Advantages of the Invention

According to the present invention, the selector valve can switch the hydraulic fluid source of the second special hydraulic actuator that drives the special attachment from the third hydraulic pump that is the hydraulic fluid source of the first hydraulic actuator and the third hydraulic actuator to the additional hydraulic pump. That is, the second special hydraulic actuator can be supplied with the hydraulic fluid from an independent hydraulic fluid source different from the hydraulic fluid source of other hydraulic actuators, and the second special hydraulic actuator can thus avoid being affected by operation of other hydraulic actuators.

Accordingly, operability for combined operation of the special attachment driven by the second special hydraulic actuator improves.

Problems, configurations and effects other than those described above are made clear by the following explanations of embodiments.

MODES FOR CARRYING OUT THE INVENTION

In the following, hydraulic drive systems for a work machine according to embodiments of the present invention are explained by using the drawings. Note that, here, a hydraulic excavator is explained as a work machine to which the hydraulic drive systems for a work machine according to the present invention is applied.

First Embodiment

Figure 1:
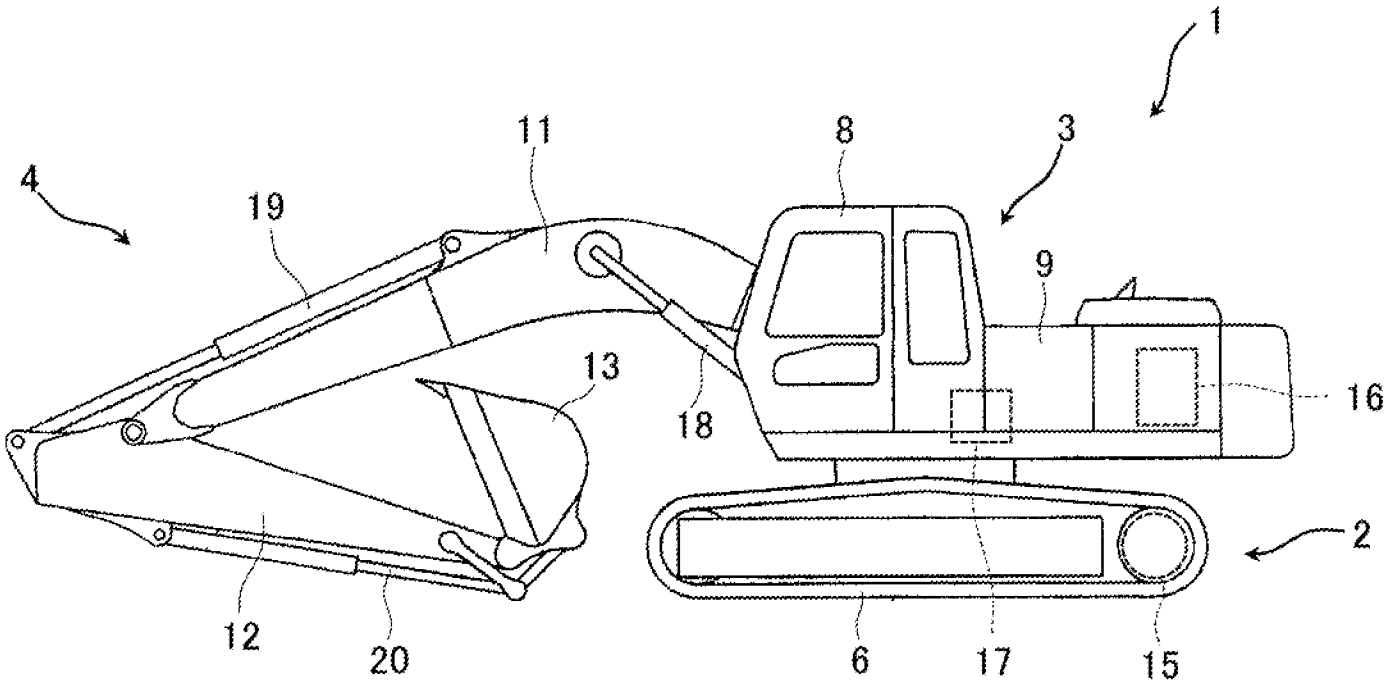
FIG. 1 is a side view illustrating a hydraulic excavator to which hydraulic drive systems for a work machine according to embodiments of the present invention is applied.

First, FIG. 1 is used to explain the configuration of the hydraulic excavator as one example of work machines to which the hydraulic drive system for a work machine according to the present invention is applied. FIG. 1 is a side view illustrating the hydraulic excavator to which the hydraulic drive system for a work machine according to an embodiment of the present invention is applied.

In FIG. 1, a hydraulic excavator 1 performs earth and sand excavation work and the like, and includes a lower travel structure 2 that can travel by itself, an upper swing structure 3 swingably mounted on the lower travel structure 2, and a front work implement 4 provided at a front end portion of the upper swing structure 3 in a raiseable and lowerable manner.

The lower travel structure 2 has crawler-type travel devices 6 on both the left and right sides (only the left crawler-type travel device is illustrated in FIG. 1). The left and right travel devices 6 are each driven by a traveling hydraulic motor 15 as a hydraulic actuator.

The upper swing structure 3 includes a cab 8 on which an operator gets, and a machine room 9 that houses various types of devices. In the cab 8, operation devices for operation performed by the operator, and the like are arranged. The machine room 9 houses a prime mover 16 such as an engine or an electric motor, hydraulic pumps, various types of valve devices and the like. The upper swing structure 3 is swing-driven by a swing hydraulic motor 17 (third hydraulic actuator) as a hydraulic actuator.

The front work implement 4 is an work device for performing work such as excavation work, and is an articulated structure including a plurality of work elements such as a boom 11, an arm 12 and a bucket 13. The boom 11 has a base end portion at which the boom 11 is coupled to the front end portion side of the upper swing structure 3 in a raiseable and lowerable manner. At a tip portion of the boom 11, a base end portion of the arm 12 is pivotably coupled thereto. At a tip portion of the arm 12, a base end portion of the bucket 13 is pivotably coupled thereto. The boom 11, the arm 12 and the bucket 13 are driven by a boom cylinder 18 (first hydraulic actuator), an arm cylinder 19 (second hydraulic actuator) and a bucket cylinder 20 as hydraulic actuators, respectively. Instead of or in addition to the bucket 13 as a standard attachment, a special attachment can be attached in the hydraulic excavator 1. Examples of special attachments include, for example, a hydraulic crusher, a hydraulic cutter, a grapple 22 mentioned below (see FIG. 2 mentioned below) and the like.

Figure 2:
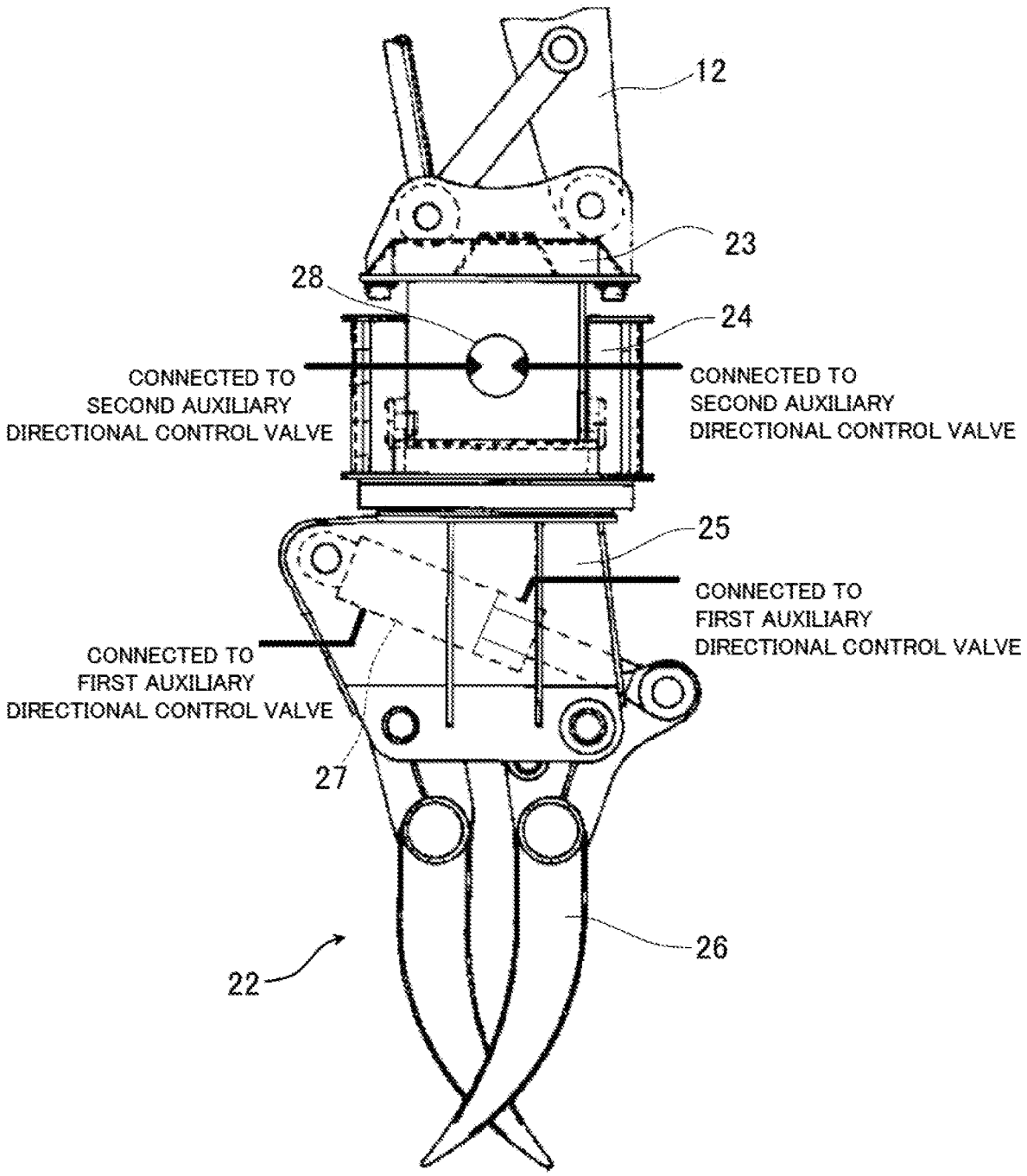
FIG. 2 is a front view illustrating a swing-type grapple that is one example of special attachments that can be attached to the hydraulic excavator illustrated in FIG. 1.

Next, FIG. 2 is used to explain the configuration of the grapple as one example of special attachments. FIG. 2 is a front view illustrating a swing-type grapple that is one example of special attachments that can be attached to the hydraulic excavator illustrated in FIG. 1. In FIG. 2, those with the same reference characters as reference characters illustrated in FIG. 1 are identical portions, and so detailed explanations thereof are omitted.

The grapple is a swing-type grapple 22 having two functions of a grappling function and a swing function, as illustrated in FIG. 2, for example. The swing-type grapple 22 includes: a bracket 23 that can be pivotably attached to the tip portion of the arm 12; a frame 25 swingably attached to the bracket 23 via a swing device 24; a fork 26 openably and closably attached to the frame 25; and a fork cylinder 27 that opens and closes the fork 26. The fork 26 is opened and closed to grapple an object such as a building material. The swing device 24 has a grapple-swing hydraulic motor 28. The rotational driving of the grapple-swing hydraulic motor 28 swings the frame 25 together with the fork 26 relative to the bracket 23.

The travel devices 6 of the lower travel structure 2, the upper swing structure 3, and work elements of the front work implement 4 including the boom 11, the arm 12 and the bucket 13 or a special attachment such as the grapple 22 that are described above are driven by a hydraulic drive system mentioned below (see FIG. 3 and FIG. 4 mentioned below).

Figure 3:
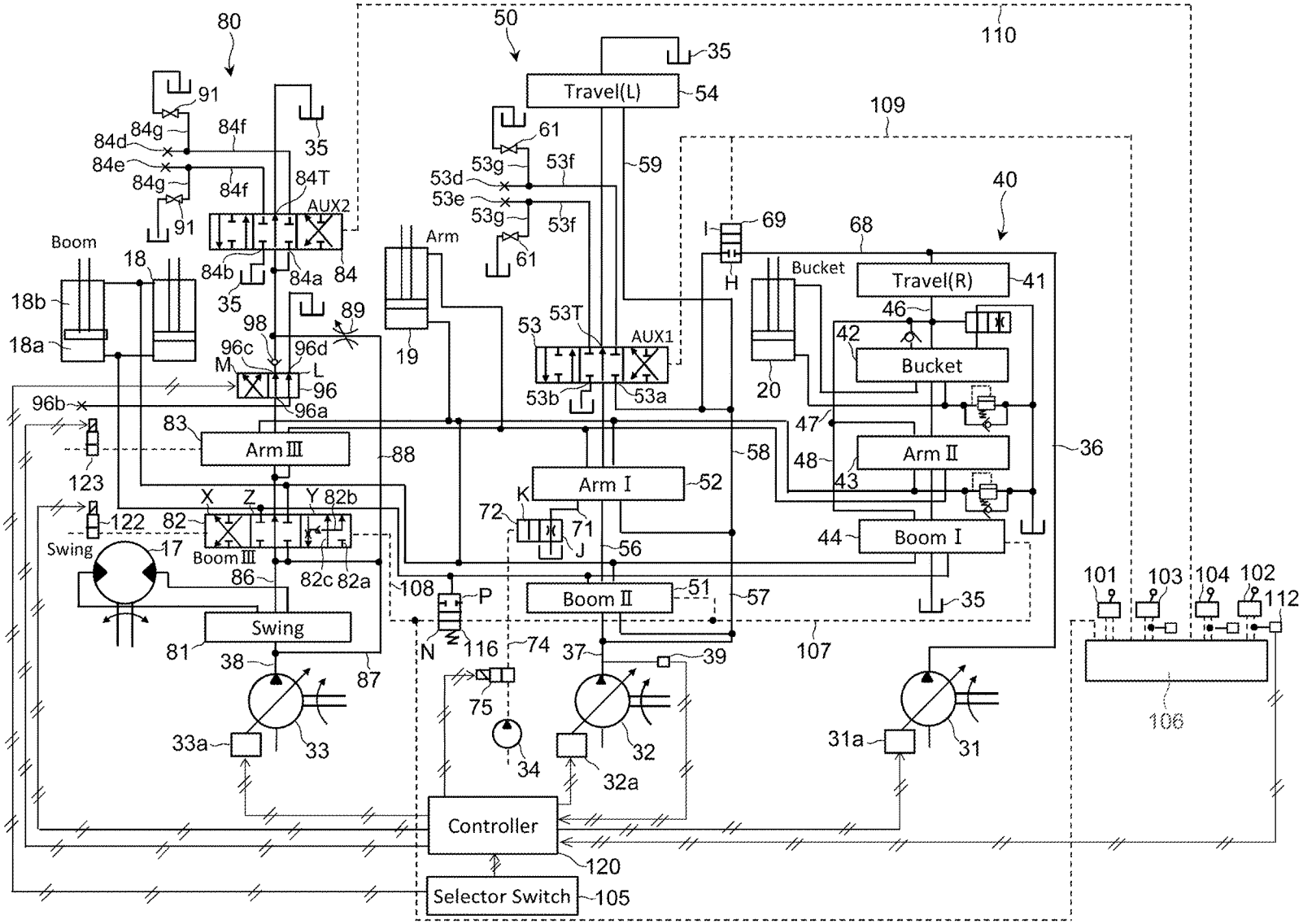
FIG. 3 is a hydraulic circuit diagram illustrating a hydraulic drive system for a work machine according to a first embodiment of the present invention in a state where a special attachment is not attached thereto.
Figure 4:
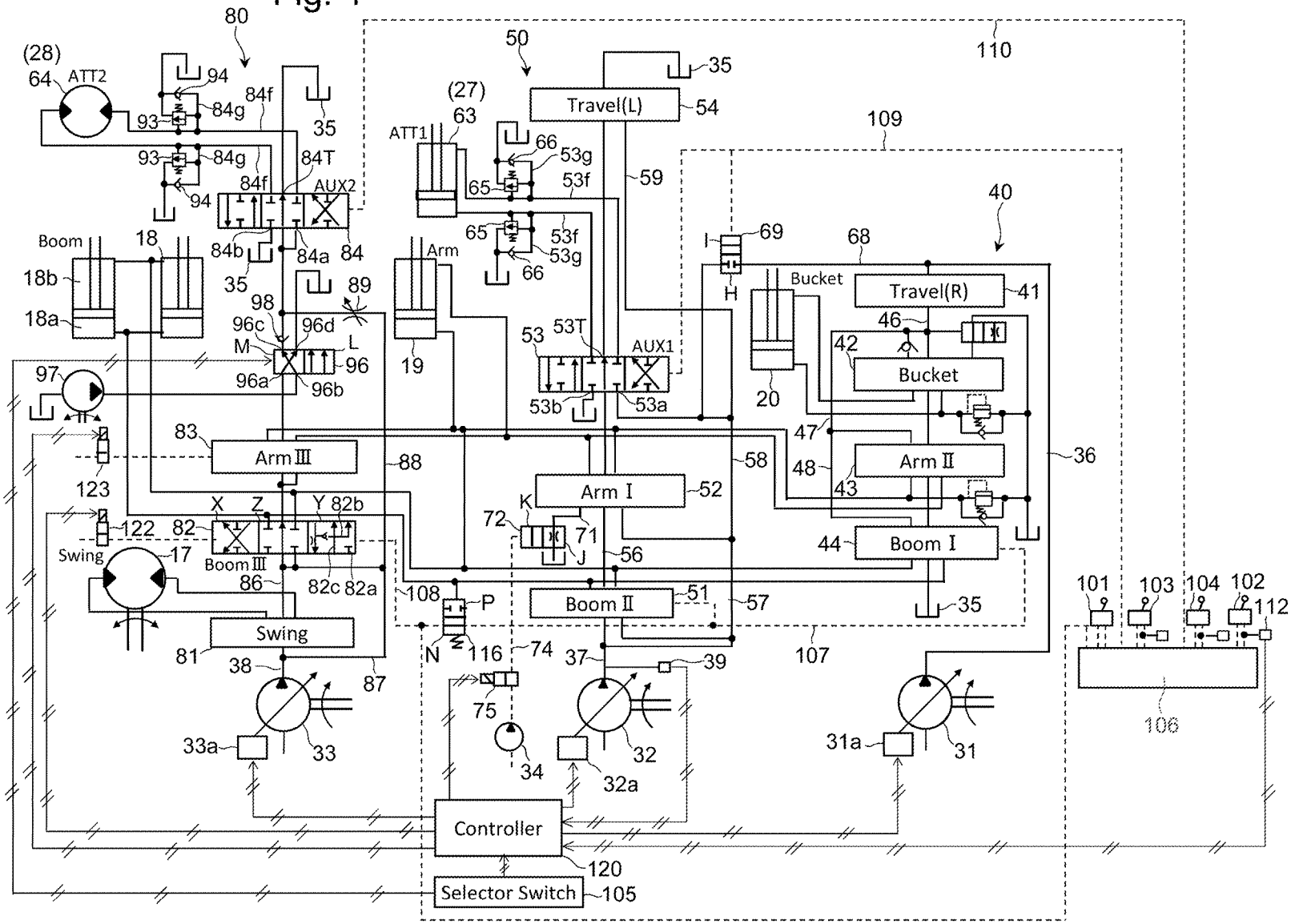
FIG. 4 is a hydraulic circuit diagram illustrating the hydraulic drive system for a work machine according to the first embodiment of the present invention in a state where a special attachment is attached thereto.

Next, FIG. 3 and FIG. 4 are used to explain the configuration of the hydraulic drive system for a work machine according to the first embodiment of the present invention. FIG. 3 is a hydraulic circuit diagram illustrating the hydraulic drive system for a work machine according to the first embodiment of the present invention in a state where a special attachment is not attached thereto, and FIG. 4 is a hydraulic circuit diagram illustrating the hydraulic drive system for a work machine according to the first embodiment of the present invention in a state where a special attachment is attached thereto. In FIG. 3 and FIG. 4, those with the same reference characters as reference characters illustrated in FIG. 1 are identical portions, and so detailed explanations thereof are omitted.

In FIG. 3, the hydraulic drive system includes: three main pumps which are a first hydraulic pump 31, a second hydraulic pump 32 and a third hydraulic pump 33 that are driven by the prime mover 16 (see FIG. 1); a pilot pump 34 driven by the prime mover 16; and a hydraulic-working-fluid tank 35 that stores a hydraulic working fluid. A first control valve group 40 including a plurality of directional control valves is connected to the first hydraulic pump 31 via a first hydraulic-fluid supply line 36. A second control valve group 50 including a plurality of directional control valves is connected to the second hydraulic pump 32 via a second hydraulic-fluid supply line 37. A third control valve group 80 including a plurality of directional control valves is connected to the third hydraulic pump 33 via a third hydraulic-fluid supply line 38. A pressure sensor 39 that senses the delivery pressure of the second hydraulic pump 32 is disposed on the second hydraulic-fluid supply line 37.

The first hydraulic pump 31, the second hydraulic pump 32 and the third hydraulic pump 33 are each configured as a variable displacement hydraulic pump, for example, and have a first regulator 31*a*, a second regulator 32*a* and a third regulator 33*a*, respectively, that regulate the tilting angles of swash plates or inclined shafts. The first regulator 31*a*, the second regulator 32*a* and the third regulator 33*a* each receive an input of a control signal from a controller 120 mentioned below, and regulate the tilting angle of the swash plate or the inclined shaft in accordance with the control signal. Thereby, the first regulator 31*a*, the second regulator 32*a* and the third regulator 33*a* control the displacement volumes (pump displacement) of the first hydraulic pump 31, the second hydraulic pump 32 and the third hydraulic pump 33.

The first control valve group 40 includes, for example, a right-travel directional control valve 41, a bucket directional control valve 42, a second arm directional control valve (second-hydraulic-actuator second directional control valve) 43 and a first boom directional control valve (first-hydraulic-actuator first directional control valve) 44. The right-travel directional control valve 41 controls the direction and flow rate of the hydraulic fluid supplied to the right traveling hydraulic motor 15 (omitted in FIG. 3) of the left and right traveling hydraulic motors 15 (see FIG. 1) that cause the lower travel structure 2 (see FIG. 1) to travel. The bucket directional control valve 42 controls the direction and flow rate of the hydraulic fluid supplied from the first hydraulic pump 31 to the bucket cylinder 20. The second arm directional control valve 43 controls the direction and flow rate of the hydraulic fluid supplied from the first hydraulic pump 31 to the arm cylinder 19. The first boom directional control valve 44 controls the direction and flow rate of the hydraulic fluid supplied from the first hydraulic pump 31 to the boom cylinder 18.

The right-travel directional control valve 41, the bucket directional control valve 42, the second arm directional control valve 43 and the first boom directional control valve 44 are each an open-center control valve, for example, and are arranged on a first center bypass line 46 in this order from the upstream side of the line 46. The first center bypass line 46 is connected to the first hydraulic-fluid supply line 36 on the upstream side, and is connected to the hydraulic-working-fluid tank 35 on the downstream side.

In the first control valve group 40, in order to prioritize the supply of the hydraulic fluid from the first hydraulic pump 31 to the right-travel directional control valve 41, the bucket directional control valve 42, the second arm directional control valve 43 and the first boom directional control valve 44 are connected in tandem to the right-travel directional control valve 41 downstream of the right-travel directional control valve 41. The bucket directional control valve 42, the second arm directional control valve 43 and the first boom directional control valve 44 are connected in parallel with each other via a first parallel hydraulic line 47 and a second parallel hydraulic line 48. The first parallel hydraulic line 47 branches off from the first center bypass line 46 downstream of the right-travel directional control valve 41 and upstream of the bucket directional control valve 42, and is connected to the inlet-port side of the second arm directional control valve 43. The second parallel hydraulic line 48 branches off from the first parallel hydraulic line 47, and is connected to the inlet-port side of the first boom directional control valve 44.

The second control valve group 50 includes, for example, a second boom directional control valve (first-hydraulic-actuator second directional control valve) 51, a first arm directional control valve (second-hydraulic-actuator first directional control valve) 52, a first auxiliary directional control valve 53 and a left-travel directional control valve 54. The second boom directional control valve 51 controls the direction and flow rate of the hydraulic fluid supplied from the second hydraulic pump 32 to the boom cylinder 18. The first arm directional control valve 52 controls the direction and flow rate of the hydraulic fluid supplied from the second hydraulic pump 32 to the arm cylinder 19. In a case where a special attachment including only a first special hydraulic actuator 63 illustrated in FIG. 4 is attached or in a case where a special attachment including two hydraulic actuators which are the first special hydraulic actuator 63 and a second special hydraulic actuator 64 illustrated in FIG. 4 is attached, instead of the bucket 13 or in addition to the bucket 13, the first auxiliary directional control valve 53 can be connected with the additional first special hydraulic actuator 63, and controls the direction and flow rate of the hydraulic fluid supplied to the first special hydraulic actuator 63. The left-travel directional control valve 54 controls the direction and flow rate of the hydraulic fluid supplied to the left traveling hydraulic motor 15 (omitted in FIG. 3) of the left and right traveling hydraulic motors 15 (see FIG. 1) that cause the lower travel structure 2 (see FIG. 1) to travel.

The second boom directional control valve 51, the first arm directional control valve 52, the first auxiliary directional control valve 53 and the left-travel directional control valve 54 are each an open-center control valve, for example, and are arranged on a second center bypass line 56 in this order from the upstream side of the line 56. The second center bypass line 56 is connected to the second hydraulic-fluid supply line 37 on its upstream side, and is connected to the hydraulic-working-fluid tank 35 on its downstream side.

In the second control valve group 50, the second boom directional control valve 51, the first arm directional control valve 52, the first auxiliary directional control valve 53 and the left-travel directional control valve 54 are connected in parallel with each other via a third parallel hydraulic line 57, a fourth parallel hydraulic line 58 and a fifth parallel hydraulic line 59. The third parallel hydraulic line 57 branches off from the second center bypass line 56 upstream of the second boom directional control valve 51, and is connected to the inlet-port side of the first arm directional control valve 52. The fourth parallel hydraulic line 58 branches off from the third parallel hydraulic line 57, and is connected to the side of an inlet port 53*a* of the first auxiliary directional control valve 53. The fifth parallel hydraulic line 59 branches off from the fourth parallel hydraulic line 58, and is connected to the inlet-port side of the left-travel directional control valve 54. That is, the directional control valves 51, 52, 53 and 54 included in the second control valve group 50 are connected, in parallel with each other, to the second hydraulic pump 32.

The first auxiliary directional control valve 53 is a six-port three-position hydraulic pilot-type control valve, for example, and is configured to be switched between a first switch position for driving the additional first special hydraulic actuator 63 illustrated in FIG. 4 in one direction, a second switch position for driving the first special hydraulic actuator 63 in another direction, and a neutral position for interrupting the supply of the hydraulic fluid to the first special hydraulic actuator 63 and guiding the hydraulic fluid from the second hydraulic pump 32 to the left-travel directional control valve 54 via the second center bypass line 56. The first auxiliary directional control valve 53 has: the inlet port 53*a* that is supplied with the hydraulic fluid from the second hydraulic pump 32; a tank port 53*b* that communicates with the hydraulic-working-fluid tank 35; a center port 53T that establishes communication when the first auxiliary directional control valve 53 is at the neutral position; and two connection ports 53*d* and 53*e* that is connectable with a hydraulic actuator. The spool position of the first auxiliary directional control valve 53 is switched in accordance with a pilot pressure supplied to the pilot operation section.

In a case where a special attachment is not attached, the connection ports 53*d* and 53*e* of the first auxiliary directional control valve 53 are blocked off by plugs as illustrated in FIG. 3. The first auxiliary directional control valve 53 has hydraulic lines 53*f* for connection of an additional hydraulic actuator, and the hydraulic lines 53*f* communicate with the hydraulic-working-fluid tank 35 via hydraulic lines 53*g*. The hydraulic lines 53*g* are for installation of relief valves 65 illustrated in FIG. 4 when an additional hydraulic actuator is connected. In a case where the relief valves 65 are not installed on the hydraulic lines 53*g*, plugs 61 are attached at positions on the hydraulic lines 53*g* where the relief valves 65 are to be disposed. On the other hand, in a case where a special attachment is attached, the additional first special hydraulic actuator 63 is connected to the connection ports 53*d* and 53*e* of the first auxiliary directional control valve 53 via the lines as illustrated in FIG. 4. The relief valves 65 and check valves 66 are disposed in parallel on the hydraulic lines 53*g*. The relief valves 65 are opened when the pressure of the hydraulic fluid in the hydraulic lines 53*f* becomes equal to or greater than a set pressure. The check valves 66 allow the flow of the hydraulic working fluid from the hydraulic-working-fluid tank 35 to the hydraulic lines 53*f*, and inhibit the flow of the hydraulic fluid from the hydraulic lines 53*f* to the hydraulic-working-fluid tank 35. In a case where the swing-type grapple (see FIG. 2) is used as a special attachment, the fork cylinder 27 (see FIG. 2) that opens and closes the fork 26 is connected to the first auxiliary directional control valve 53 as the additional first special hydraulic actuator 63.

The inlet port 53*a* of the first auxiliary directional control valve 53 communicates with the first hydraulic-fluid supply line 36 via a merge line 68. On the merge line 68, an auxiliary merge valve 69 that switches the state of the merge line 68 between the communicating state and the interrupting state is disposed. When the auxiliary merge valve 69 is switched to an interruption position H, the supply of the hydraulic fluid from the first hydraulic pump 31 to the first auxiliary directional control valve 53 is interrupted. On the other hand, if the auxiliary merge valve 69 is switched to a communication position I, the hydraulic fluid from the first hydraulic pump 31 merges with the hydraulic fluid from the second hydraulic pump 32, and the merged flow is supplied to the first auxiliary directional control valve 53. That is, the auxiliary merge valve 69 allows the hydraulic fluid delivered from the first hydraulic pump to be supplied to the first auxiliary directional control valve 53. For example, in a case where a first auxiliary operation device 103 mentioned below is operated, the auxiliary merge valve 69 is switched to the communication position I in accordance with an operation signal (e.g. a pilot pressure) according to the operation, and in a case where the first auxiliary operation device 103 is not operated, the auxiliary merge valve 69 is switched to the interruption position H.

The tank port of the first arm directional control valve 52 communicates with the hydraulic-working-fluid tank 35 via a return line 71, and an open valve 72 is disposed on the return line 71. The open valve 72 is controlled such that its opening is kept small at the time when the arm 12 (see FIG. 1) is not operated, and its opening becomes larger as the operation amount at the time of arm-crowding increases. The pilot operation section of the open valve 72 is supplied with a pilot pressure from the pilot pump 34 via a first pilot line 74. A first solenoid valve 75 is disposed on the first pilot line 74. In a case where the first solenoid valve 75 is at the interruption position, the pilot pressure of the pilot pump 34 is not input to the pilot operation section of the open valve 72, and the open valve 72 is kept at a restricting position J where the open valve 72 restricts the flow of the hydraulic fluid. On the other hand, in a case where the first solenoid valve 75 is at the maximum opening position, the pilot pressure is input to the pilot operation section of the open valve 72, and the open valve 72 is switched to the full-open position K where the open valve 72 does not restrict the flow of the hydraulic fluid. The opening of the first solenoid valve 75 is controlled in accordance with a control signal from the controller 120 mentioned below.

The third control valve group 80 includes, for example, a swing directional control valve (third-hydraulic-actuator directional control valve) 81, a third boom directional control valve 82, a third arm directional control valve 83 and a second auxiliary directional control valve 84. The swing directional control valve 81 controls the direction and flow rate of the hydraulic fluid supplied from the third hydraulic pump 33 to the swing hydraulic motor 17. The third boom directional control valve 82 controls the direction and flow rate of the hydraulic fluid supplied from the third hydraulic pump 33 to the boom cylinder 18. The third arm directional control valve 83 controls the direction and flow rate of the hydraulic fluid supplied from the third hydraulic pump 33 to the arm cylinder 19. In a case where another special attachment including the second special hydraulic actuator 64 illustrated in FIG. 4 is attached further in addition to the special attachment including the first special hydraulic actuator 63 illustrated in FIG. 4 or in a case where a special attachment including two hydraulic actuators which are the first special hydraulic actuator 63 and the second special hydraulic actuator 64 is attached, the second auxiliary directional control valve 84 can be connected with the additional second special hydraulic actuator 64, and controls the direction and flow rate of the hydraulic fluid supplied to the additional second special hydraulic actuator 64.

The swing directional control valve 81, the third boom directional control valve 82, the third arm directional control valve 83 and the second auxiliary directional control valve 84 are open-center directional control valves, for example, and are arranged on a third center bypass line 86 in series in this order from the upstream side of the line 86. The third center bypass line 86 is connected to the third hydraulic-fluid supply line 38 on its upstream side, and is connected to the hydraulic-working-fluid tank 35 on its downstream side.

In the third control valve group 80, the swing directional control valve 81, the third boom directional control valve 82 and the second auxiliary directional control valve 84 are connected in parallel with each other via a sixth parallel hydraulic line 87 and a seventh parallel hydraulic line 88. The sixth parallel hydraulic line 87 branches off from the third center bypass line 86 upstream of the swing directional control valve 81, and is connected to the inlet-port side of the third boom directional control valve 82. The seventh parallel hydraulic line 88 branches off from the sixth parallel hydraulic line 87, and is connected to the third center bypass line 86 upstream of the second auxiliary directional control valve 84 and downstream of the third arm directional control valve 83. That is, the swing directional control valve 81, the third boom directional control valve 82 and the second auxiliary directional control valve 84 are connected, in parallel with each other, to the third hydraulic pump 33. The third arm directional control valve 83 is connected in tandem with the third boom directional control valve 82 downstream of the third boom directional control valve 82. A variable restrictor 89 is disposed on the seventh parallel hydraulic line 88.

The third boom directional control valve 82 is a three-position hydraulic pilot-type directional control valve, for example, and is configured to be switched between a boom-raising position X for pivoting the boom 11 (see FIG. 1) upward, a boom-lowering position Y for pivoting the boom 11 downward, and a neutral position Z for interrupting communication between the third hydraulic pump 33 and the boom cylinder 18 to guide the hydraulic fluid from the third hydraulic pump 33 to the third arm directional control valve 83. At the boom-lowering position Y of the third boom directional control valve 82, an inhibition port 82*a* that inhibits the supply, to the boom cylinder 18, of the hydraulic fluid delivered from the third hydraulic pump 33 is provided. Also, at the boom-lowering position Y, a regeneration line 82*b* that can regenerate and supply the hydraulic working fluid discharged from a bottom chamber 18*a* of the boom cylinder 18 to a rod chamber 18*b* along with boom-lowering operation, and a hydraulic line 82*c* that guides the hydraulic fluid from the third hydraulic pump 33 to the third arm directional control valve 83 are provided.

The second auxiliary directional control valve 84 is a six-port three-position hydraulic pilot-type directional control valve, for example, and is configured to be switched between a first switch position for driving the second special hydraulic actuator 64 illustrated in FIG. 4 in one direction, a second switch position for driving the second special hydraulic actuator 64 in another direction, and a neutral position for interrupting the supply of the hydraulic fluid to the second special hydraulic actuator 64 to guide the hydraulic fluid to the hydraulic-working-fluid tank 35. The second auxiliary directional control valve 84 has: an inlet port 84*a* that is supplied with the hydraulic fluid; a tank port 84*b* that communicates with the hydraulic-working-fluid tank 35; a center port 84T that establishes communication at the time when the second auxiliary directional control valve 84 is at the neutral position; and two connection ports 84*d* and 84*e* that is connectable with the additional second special hydraulic actuator 64 that drives a special attachment. The spool position of the second auxiliary directional control valve 84 is switched in accordance with a pilot pressure supplied to the pilot operation section.

In a case where a special attachment is not attached, the two connection ports 84*d* and 84*e* of the second auxiliary directional control valve 84 are blocked off by using plugs as illustrated in FIG. 3. The second auxiliary directional control valve 84 has hydraulic lines 84*f* for connection of an additional hydraulic actuator, and the hydraulic lines 84*f* communicate with the hydraulic-working-fluid tank 35 via hydraulic lines 84*g*. The hydraulic lines 84*g* are for installation of relief valves 93 illustrated in FIG. 4 when an additional hydraulic actuator is connected. In a case where the relief valves 93 are not installed on the hydraulic lines 84*g*, plugs 91 are attached at positions on the hydraulic line 84*g* where the relief valves 93 are to be disposed. On the other hand, in a case where a special attachment is used, the additional second special hydraulic actuator 64 is connected to the connection ports 84*d* and 84*e* of the second auxiliary directional control valve 84 via the lines as illustrated in FIG. 4. The relief valves 93 and check valves 94 are disposed in parallel on the hydraulic lines 84*g*. The relief valves 93 are opened when the pressure of the hydraulic fluid in the hydraulic lines 84*f* becomes equal to or greater than a set pressure. The check valves 94 allow the flow of the hydraulic working fluid from the hydraulic-working-fluid tank 35 to the hydraulic lines 84*f*, and inhibit the flow of the hydraulic fluid from the hydraulic lines 84*f* to the hydraulic-working-fluid tank 35. In a case where the swing-type grapple 22 (see FIG. 2) is used as a special attachment, the grapple-swing hydraulic motor 28 (see FIG. 2) is connected to the second auxiliary directional control valve 84 as the additional second special hydraulic actuator 64.

A first selector valve 96 is arranged on the third center bypass line 86 downstream of the third arm directional control valve 83 and upstream of the second auxiliary directional control valve 84. More specifically, the first selector valve 96 is provided at a portion on the third center bypass line 86 downstream of the third arm directional control valve 83 and upstream of a connecting portion between the third center bypass line 86 and the seventh parallel hydraulic line 88. The first selector valve 96 is connectable with a retrofit additional hydraulic pump 97 for supplying the hydraulic fluid to the second special hydraulic actuator 64 that drives a special attachment. The first selector valve 96 switches a hydraulic fluid source of the second special hydraulic actuator 64 between the third hydraulic pump 33 and the retrofit additional hydraulic pump 97 while keeping the third hydraulic pump 33 as a hydraulic fluid source of the swing hydraulic motor 17, the boom cylinder 18 and the arm cylinder 19.

The first selector valve 96 is a four-port two-position solenoid selector valve, for example. The first selector valve 96 is configured to be switched between a first switch position L for switching a hydraulic fluid source of the second special hydraulic actuator 64 illustrated in FIG. 4 to the third hydraulic pump 33 and a second switch position M for switching a hydraulic fluid source of the second special hydraulic actuator 64 to the additional hydraulic pump 97. The first selector valve 96 has: a first inlet port 96*a* that is supplied with the hydraulic fluid from the third hydraulic pump 33 via the third arm directional control valve 83; a second inlet port 96*b* that is connectable with the additional hydraulic pump 97; an outlet port 96*c* that communicates with the second auxiliary directional control valve 84; and a tank port 96*d* that communicates with the hydraulic-working-fluid tank 35.

When the first selector valve 96 is at the first switch position L, the first inlet port 96*a* and outlet port 96*c* of the first selector valve 96 communicate with each other, and the second inlet port 96*b* and the tank port 96*d* communicate with each other. When the first selector valve 96 is at the first switch position L, the first selector valve 96 guides, to the second auxiliary directional control valve 84, the hydraulic fluid supplied from the third hydraulic pump 33 through the third arm directional control valve 83. On the other hand, when the first selector valve 96 is at the second switch position M, the first inlet port 96*a* and the tank port 96*d* communicate with each other, and the second inlet port 96*b* and the outlet port 96*c* communicate with each other. When the first selector valve 96 is at the second switch position M, the first selector valve 96 guides, to the second auxiliary directional control valve 84, the hydraulic fluid supplied from the additional hydraulic pump 97. On the other hand, the first selector valve 96 guides, to the hydraulic-working-fluid tank 35, the hydraulic fluid supplied from the third hydraulic pump 33 through the third arm directional control valve 83.

A check valve 98 is disposed downstream of the first selector valve 96. The check valve 98 allows the flow from the first selector valve 96 toward the side on which the second auxiliary directional control valve 84 is located, and inhibits the flow from the side on which the second auxiliary directional control valve 84 is located to the first selector valve 96.

In addition, the hydraulic drive system includes: a boom operation device 101 that can switch the positions of the first boom directional control valve 44, the second boom directional control valve 51 and the third boom directional control valve 82; an arm operation device 102 that can switch the positions of the first arm directional control valve 52, the second arm directional control valve 43 and the third arm directional control valve 83; a first auxiliary operation device 103 that can switch the positions of the first auxiliary directional control valve 53; a second auxiliary operation device 104 that can switch the positions of the second auxiliary directional control valve 84; and a selector switch 105 that can switch the positions of the first selector valve 96. The selector switch 105 gives an instruction for switching a hydraulic fluid source of the additional second special hydraulic actuator 64 for driving a special attachment in a case of special use when the special attachment is attached and the retrofit additional hydraulic pump 97 is used. Specifically, by switching the selector switch 105 between a standard use position for giving an instruction for not using an additional hydraulic pump and a special use position for giving an instruction for using the additional hydraulic pump 97, an instruction for the switch position of the first selector valve 96 is given.

The pilot pressure of the boom operation device 101 is supplied to the pilot operation sections of the first boom directional control valve 44 and the second boom directional control valve 51 via a second pilot line 107, and is supplied to the pilot operation section of the third boom directional control valve 82 via a third pilot line 108. The pilot pressure of the first auxiliary operation device 103 is supplied to the pilot operation section of the first auxiliary directional control valve 53 and the pilot operation section of the auxiliary merge valve 69 via a fourth pilot line 109. The pilot pressure of the second auxiliary operation device 104 is supplied to the pilot operation section of the second auxiliary directional control valve 84 via a fifth pilot line 110. A pilot pressure sensor 112 that senses arm-crowding operation is provided to the arm operation device 102.

Note that illustrations and explanations of a bucket operation device that can switch the positions of the bucket directional control valve 42, a swing operation device that can switch the positions of the swing directional control valve 81, a right travel operation device that can switch the positions of the right-travel directional control valve 41, and a left travel operation device that can switch the positions of the left-travel directional control valve 54 are omitted.

A second selector valve 116 is disposed on the second pilot line 107. The second selector valve 116 switches the state of the second pilot line 107 between the communicating state and the interrupting state. The second selector valve 116 is configured to receive an input of the bottom pressure of the boom cylinder 18 at the pilot operation section of the second selector valve 116. When the bottom pressure of the boom cylinder 18 becomes equal to or greater than a predetermined pressure, the second selector valve 116 is switched to an interruption position P against the force of a spring. Thereby, when the boom operation device 101 is operated toward the boom-lowering side, the third boom directional control valve 82 is kept at the boom-lowering position Y, and the first boom directional control valve 44 and the second boom directional control valve 51 are kept at neutral positions. In addition, when the bottom pressure of the boom cylinder 18 is below the predetermined pressure, the force of the spring switches the second selector valve 116 to a communication position N. Thereby, when the boom operation device 101 is operated toward the boom-lowering side, the third boom directional control valve 82 is kept at the neutral position Z, and the first boom directional control valve 44 and the second boom directional control valve 51 are kept at boom-lowering positions (not illustrated).

That is, when the bottom pressure of the boom cylinder 18 is equal to or greater than the predetermined pressure at the time of boom-lowering in the air, the second selector valve 116 keeps the third boom directional control valve 82 at the boom-lowering position Y, and keeps the first boom directional control valve 44 and the second boom directional control valve 51 at the neutral positions. Furthermore, when the bottom pressure of the boom cylinder 18 is below the predetermined pressure mentioned above along with boom-lowering operation in the state where an attachment is touching the ground, that is, along with jack-up operation, the third boom directional control valve 82 is kept at the neutral position Z, the first boom directional control valve 44 is kept at the boom-lowering position (not illustrated) that allows the hydraulic fluid delivered from the first hydraulic pump 31 to be supplied to the rod chamber 18*b* of the boom cylinder 18, and the second boom directional control valve 51 is kept at the boom-lowering position (not illustrated) that allows the hydraulic fluid delivered from the second hydraulic pump 32 to be supplied to the rod chamber 18*b* of the boom cylinder 18.

The hydraulic drive system further includes the controller 120. The controller 120 performs control such that the first solenoid valve 75 is kept at a closed position in a case where a sensing signal is not output from the pilot pressure sensor 112. On the other hand, in a case where a sensing signal is output from the pilot pressure sensor 112, the controller 120 controls the opening of the first solenoid valve 75 in accordance with the magnitude of the sensing signal.

The controller 120 is electrically connected to a second solenoid valve 122 and a third solenoid valve 123. In a case where the delivery pressure of the second hydraulic pump 32 sensed by the pressure sensor 39 is equal to or greater than a predetermined pressure equivalent to large excavation force at the time of heavy excavation work, the controller 120 outputs a control signal for keeping the third boom directional control valve 82 and the third arm directional control valve 83 at the neutral positions to the second solenoid valve 122 and the third solenoid valve 123.

In addition, the controller 120 is electrically connected to the selector switch 105, and performs control such that the variable restrictor 89 is closed in a case where the position indicated by a switch instruction of the selector switch 105 is the second switch position M.

Next, FIG. 3 and FIG. 4 are used to explain operation of the hydraulic drive system for a work machine according to the first embodiment of the present invention. In the case explained first of all, the front work implement 4 includes the boom 11, the arm 12 and the bucket 13 as the standard attachment, and a retrofit additional hydraulic pump is not used.

As illustrated in FIG. 3, no hydraulic actuators are connected to the first auxiliary directional control valve 53 and the second auxiliary directional control valve 84. In addition, no additional hydraulic pumps are connected to the first selector valve 96. The selector switch 105 is set to the standard use position, and the first selector valve 96 is kept at the first switch position L. Thereby, the second auxiliary directional control valve 84 is supplied with the hydraulic fluid delivered from the third hydraulic pump 33 via the third arm directional control valve 83 or the seventh parallel hydraulic line 88. Since the second auxiliary operation device 104 is not operated, the second auxiliary directional control valve 84 is positioned at the neutral position. Accordingly, the hydraulic fluid supplied from the third hydraulic pump 33 to the second auxiliary directional control valve 84 is guided to the hydraulic-working-fluid tank 35.

In the case explained secondly, the swing-type grapple 22, which is a special attachment, is attached instead of the bucket 13 as the standard attachment, and the retrofit additional hydraulic pump 97 is used.

As illustrated in FIG. 4, the additional fork cylinder (first special hydraulic actuator 63) for opening and closing the fork 26 of the swing-type grapple 22 (see FIG. 2) is connected to the connection ports 53*d* and 53*e* of the first auxiliary directional control valve 53. The grapple-swing hydraulic motor 28 (second special hydraulic actuator 64) of the swing-type grapple 22 is connected to the connection ports 84*d* and 84*e* of the second auxiliary directional control valve 84. Furthermore, the additional hydraulic pump 97 is connected to the second inlet port 96*b* of the first selector valve 96.

The selector switch 105 is switched to the special use position for giving an instruction for using an additional hydraulic pump. An instruction signal (excitation current) of the selector switch 105 switches the first selector valve 96 to the second switch position M. At this time, the controller 120 performs control such that the variable restrictor 89 is closed. Thereby, while the hydraulic fluid source of the swing hydraulic motor 17, the boom cylinder 18 and the arm cylinder 19 respectively connected to the swing directional control valve 81, the third boom directional control valve 82 and the third arm directional control valve 83 is still the third hydraulic pump 33, the hydraulic fluid source of the additional grapple-swing hydraulic motor 28 connected to the second auxiliary directional control valve 84 is switched to the additional hydraulic pump 97.

In this state, single operation of a swing of the grapple 22 is performed. When the second auxiliary operation device 104 is operated, the second auxiliary directional control valve 84 is switched to a switch position according to the operation direction. Thereby, the hydraulic fluid delivered from the additional hydraulic pump 97 is supplied to the grapple-swing hydraulic motor 28 via the first selector valve 96 and the second auxiliary directional control valve 84. The supply of the hydraulic fluid from the additional hydraulic pump 97 drives the grapple-swing hydraulic motor 28, and swings the fork 26 of the grapple 22 right or left in accordance with the operation direction of the second auxiliary operation device 104. On the other hand, the hydraulic fluid delivered from the third hydraulic pump 33 is guided to the hydraulic-working-fluid tank 35 via the swing directional control valve 81, the third boom directional control valve 82, the third arm directional control valve 83 and the first selector valve 96.

In this state, combined operation of swing operation of the upper swing structure 3, operation of the boom 11 and the arm 12, and swing operation of the grapple 22 is performed. When the unillustrated swing operation device, the boom operation device 101, the arm operation device 102 and the second auxiliary operation device 104 are operated, the swing directional control valve 81, the first to third boom directional control valves 44, 51 and 82, the first to third arm directional control valves 43, 52 and 83, and the second auxiliary directional control valve 84 are switched to switch positions according to the operation directions.

Since the third arm directional control valve 83 is connected in tandem at the downstream of the swing directional control valve 81 and the third boom directional control valve 82 while the swing directional control valve 81 and the third boom directional control valve 82 are connected, in parallel with each other, to the third hydraulic pump 33, the hydraulic fluid of the third hydraulic pump 33 is supplied to the swing hydraulic motor 17 via the swing directional control valve 81 or to the boom cylinder 18 via the third boom directional control valve 82. Since the upper swing structure 3 is a large inertial body, the operation load pressure of the swing hydraulic motor 17 is large at the time of starting, but the operation load pressure tends to decrease along with acceleration after the starting. In contrast to this, the operation load pressure of the boom cylinder 18 is kept large. The hydraulic fluid supplied from the third hydraulic pump 33 to the swing hydraulic motor 17 and the boom cylinder 18 is determined in accordance with the operation load pressures of the swing hydraulic motor 17 and the boom cylinder 18.

In addition, since the first boom directional control valve 44 and the second arm directional control valve 43 are connected in parallel, the hydraulic fluid of the first hydraulic pump 31 is supplied to the boom cylinder 18 via the first boom directional control valve 44 or to the arm cylinder 19 via the second arm directional control valve 43 depending on the operation load pressures of the boom cylinder 18 and the arm cylinder 19.

In addition, since the second boom directional control valve 51 and the first arm directional control valve 52 are connected in parallel, the hydraulic fluid of the second hydraulic pump 32 is supplied to the boom cylinder 18 via the second boom directional control valve 51 or to the arm cylinder 19 via the first arm directional control valve 52 depending on the operation load pressures of the boom cylinder 18 and the arm cylinder 19.

Thereby, favorable operability for combined operation of the upper swing structure 3, the boom 11 and the arm can be ensured.

On the other hand, the hydraulic fluid delivered from the additional hydraulic pump 97 is supplied to the grapple-swing hydraulic motor 28 via the first selector valve 96 and the second auxiliary directional control valve 84 since the first selector valve 96 has been switched to the second switch position M. Thereby, the grapple-swing hydraulic motor 28 is driven to swing the fork 26 of the grapple 22 right or left. The hydraulic fluid source of the grapple-swing hydraulic motor 28 is not the third hydraulic pump 33 shared by the swing hydraulic motor 17, the boom cylinder 18 and the arm cylinder 19, but is the additional hydraulic pump 97. Accordingly, irrespective of the magnitudes of the operation load pressures of the swing hydraulic motor 17, the boom cylinder 18 and the arm cylinder 19, the hydraulic fluid from the additional hydraulic pump 97 is surely supplied to the grapple-swing hydraulic motor 28. That is, swing operation of the grapple 22 is not affected by swing operation of the upper swing structure 3, boom operation, and arm operation. Accordingly, favorable operation of combined operation of a swing of the grapple 22, which is a special attachment, a swing of the upper swing structure 3, and the boom 11 and the arm 12 can be ensured. Note that since the variable restrictor 89 is closed, the hydraulic fluid of the third hydraulic pump 33 is not supplied to the grapple-swing hydraulic motor 28 via the seventh parallel hydraulic line 88 and the second auxiliary directional control valve 84.

In this manner, in the present embodiment, by switching the first selector valve 96 to the second switch position M in a case where a special attachment is attached and the retrofit additional hydraulic pump 97 is used, the hydraulic fluid source of the second special hydraulic actuator 64 that drives the special attachment can be switched not to the third hydraulic pump 33 that are shared by the swing hydraulic motor 17, the boom cylinder 18 and the arm cylinder 19, but to the additional hydraulic pump 97. That is, the second special hydraulic actuator 64 can singly use the additional hydraulic pump 97 as a hydraulic fluid source. Accordingly, operability for combined operation of the special attachment driven by the second special hydraulic actuator 64 improves.

In the case explained thirdly, a special attachment different from the swing-type grapple 22 is attached instead of the bucket 13 as the standard attachment, but a retrofit additional hydraulic pump is not used. There are some special attachments that are not required to have favorable operability for combined operation, unlike swing operation of the swing-type grapple 22. In a case where such a special attachment is attached, the existing third hydraulic pump 33 can also be used as the hydraulic fluid source of the second special hydraulic actuator 64 that drives the special attachment.

For example, the additional first special hydraulic actuator 63 for driving a first special attachment is connected to the first auxiliary directional control valve 53, and the second special hydraulic actuator 64 for driving a second special attachment is connected to the second auxiliary directional control valve 84. On the other hand, no hydraulic pumps are connected to the first selector valve 96.

An operator sets the selector switch 105 to the standard use position for giving an instruction for not using an additional hydraulic pump, similar to the case where only the bucket 13, which is the standard attachment, is used. In this case, the first selector valve 96 is kept at the first switch position L.

In this state, single operation of the second special attachment is performed. When the second auxiliary operation device 104 is operated, the second auxiliary directional control valve 84 is switched to a switch position according to the operation direction. Thereby, the hydraulic fluid delivered from the third hydraulic pump 33 is supplied to the second special hydraulic actuator 64 via the swing directional control valve 81, the third boom directional control valve 82, the third arm directional control valve 83, the first selector valve 96 and the second auxiliary directional control valve 84, and the second special attachment is driven.

In addition, in this state, combined operation of a swing of the upper swing structure 3, and the second special attachment is performed, for example. When the unillustrated swing operation device and the second auxiliary operation device 104 are operated, the swing directional control valve 81 and the second auxiliary directional control valve 84 are switched to switch positions according to the operation directions. Thereby, the hydraulic fluid of the third hydraulic pump 33 is supplied to the swing hydraulic motor 17 via the swing directional control valve 81, and the upper swing structure 3 is swung. In addition, the hydraulic fluid of the third hydraulic pump 33 is supplied to the second special hydraulic actuator 64 from the sixth parallel hydraulic line 87 and the seventh parallel hydraulic line 88 via the second auxiliary directional control valve 84, and the second special attachment is driven. At this time, the opening of the variable restrictor 89 is regulated in accordance with the level of the operation load pressure of the second special hydraulic actuator 64 relative to the operation load pressure of the swing hydraulic motor 17. Thereby, the supply flow rate can be appropriately allocated to the swing hydraulic motor 17 and the second special hydraulic actuator 64. In this manner, combined operation of a swing of the upper swing structure 3 and the second special attachment can be performed.

According to the hydraulic drive system for a work machine according to the first embodiment of the present invention mentioned above, the first selector valve 96 can switch the hydraulic fluid source of the second special hydraulic actuator 64 (e.g. the grapple-swing hydraulic motor 28) that drives a special attachment (e.g. the swing-type grapple 22) from the third hydraulic pump 33 that is the hydraulic fluid source of the swing hydraulic motor 17 (third hydraulic actuator) and the boom cylinder 18 (first hydraulic actuator) to the additional hydraulic pump 97. That is, since the second special hydraulic actuator 64 can be supplied with the hydraulic fluid from an independent hydraulic fluid source different from the hydraulic fluid source of other hydraulic actuators, the second special hydraulic actuator 64 can avoid being affected by operation performed for the other hydraulic actuators. Accordingly, operability for combined operation of the special attachment (grapple 22) driven by the second special hydraulic actuator 64 (e.g. the grapple-swing hydraulic motor 28) improves.

In addition, according to the present embodiment, in the hydraulic drive system equipped in advance with the second auxiliary directional control valve 84 that is connectable with the additional second special hydraulic actuator 64 for driving a special attachment, the hydraulic fluid source of the second special hydraulic actuator 64 can be switched by connecting the two-position first selector valve 96 to the third hydraulic pump 33 at the upstream of the second auxiliary directional control valve 84. Accordingly, improvement in operability for combined operation of a special attachment can be realized with a simple configuration.

In addition, according to the present embodiment, since the second auxiliary directional control valve 84 is connected, in parallel with the swing directional control valve 81 and the third boom directional control valve 82, to the third hydraulic pump 33 via the seventh parallel hydraulic line 88, and the variable restrictor 89 is disposed on the seventh parallel hydraulic line 88, a special attachment can be operated in combination with other work elements such as the boom or the arm even in a case where an additional hydraulic pump is not used.

Modification Example of First Embodiment

Figure 5:
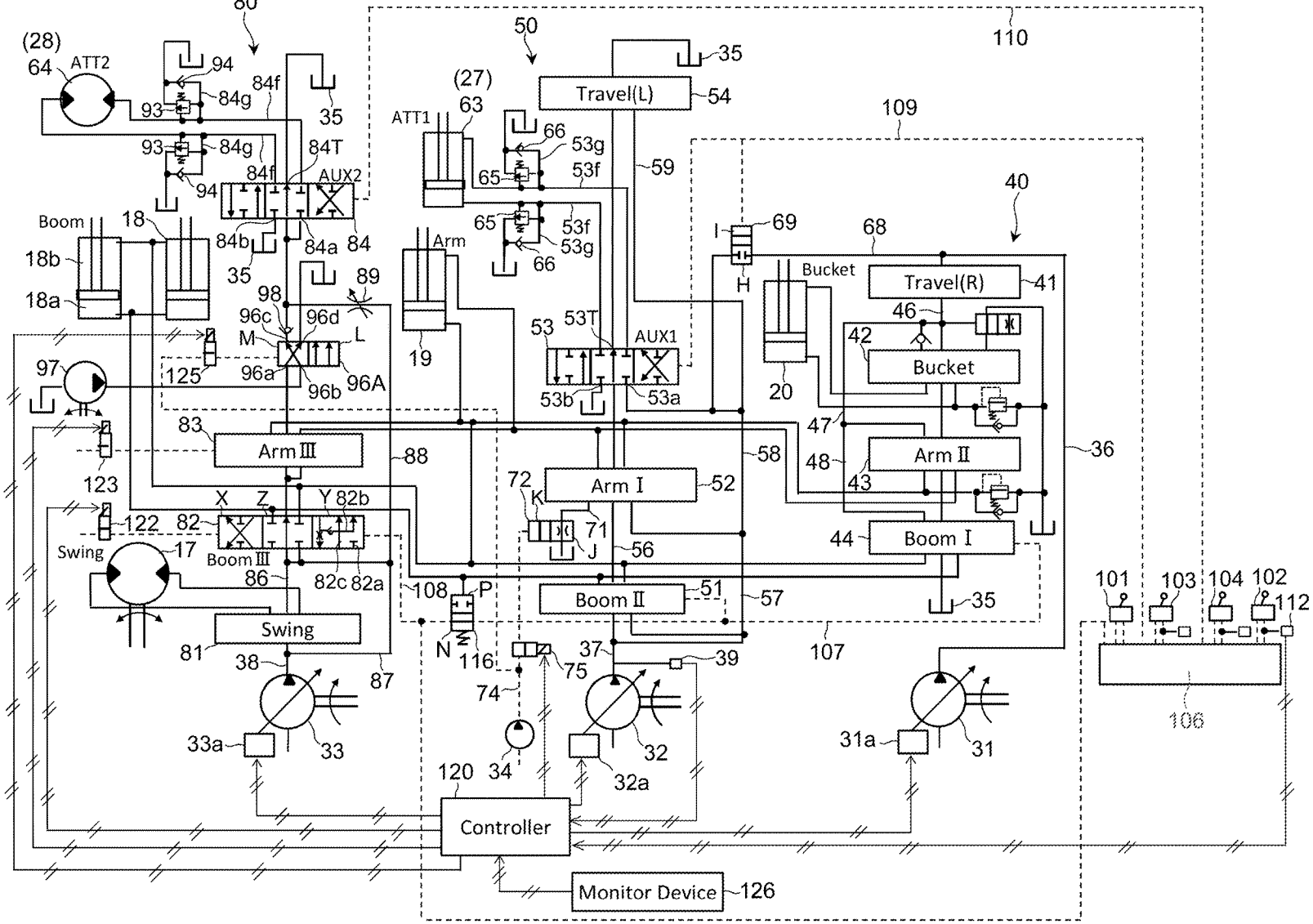
FIG. 5 is a hydraulic circuit diagram illustrating a hydraulic drive system for a work machine according to a modification example of the first embodiment of the present invention in a state where a special attachment is attached thereto.

Next, FIG. 5 is used to explain a hydraulic drive system for a work machine according to a modification example of the first embodiment of the present invention. FIG. 5 is a hydraulic circuit diagram illustrating the hydraulic drive system for a work machine according to the modification example of the first embodiment of the present invention in a state where a special attachment is attached thereto. Note that in FIG. 5, those with the same reference characters as reference characters illustrated in FIG. 1 to FIG. 4 are similar portions, and so detailed explanations thereof are omitted.

There are three major differences of the hydraulic drive system for a work machine according to the modification example of the first embodiment of the present invention illustrated in FIG. 5 from the first embodiment as follows. Firstly, a first selector valve 96A is configured not of a solenoid-type selector valve, but of a hydraulic pilot-type selector valve. Secondly, a fourth solenoid valve 125 is added that switches the state of the pilot pressure to be input to the pilot operation section of the first selector valve 96A between the supplied state and the interrupted state. Thirdly, as a configuration to give an instruction for operation of switching the first selector valve 96A, a monitor device 126 including a display section and an input section is used instead of the selector switch 105.

In accordance with whether or not there is a control signal (excitation current) from the controller 120, the fourth solenoid valve 125 is switched between a communication position for allowing the supply of the pilot pressure from the pilot pump 34 to the pilot operation section of the first selector valve 96A and an interruption position for interrupting the supply of the pilot pressure. The monitor device 126 allows an operator to perform operation to input a switch instruction for the first selector valve 96A, and outputs the input switch instruction to the controller 120.

When the monitor device 126 outputs, to the controller 120, the switch instruction for the first selector valve 96A in accordance with the input operation performed by the operator, the controller 120 switches the fourth solenoid valve 125 to the communication position. Thereby, the pilot operation section of the first selector valve 96A is supplied with the pilot pressure, and the first selector valve 96A is switched to the second switch position M. In this manner, in the present modification example, unlike the first embodiment, by the operator inputting a switch instruction for the first selector valve 96A via the monitor device 126, the fourth solenoid valve 125 is switched to operate the first selector valve 96A by the pilot pressure. Thereby, the hydraulic fluid source of the second special hydraulic actuator 64 can be switched from the third hydraulic pump 33 to the additional hydraulic pump 97.

As shown in FIGS. 3-7, element 106 is used to omit pilot lines connecting the operation devices 101, 102, 103, and 104 to the various to the various directional control valves 41 to 44, 51 to 54, and 81 to 84.

According to the hydraulic drive system for a work machine according to the modification example of the first embodiment of the present invention mentioned above, operability for combined operation of a special attachment can be improved, similar to the first embodiment mentioned before.

Second Embodiment

Figure 6:
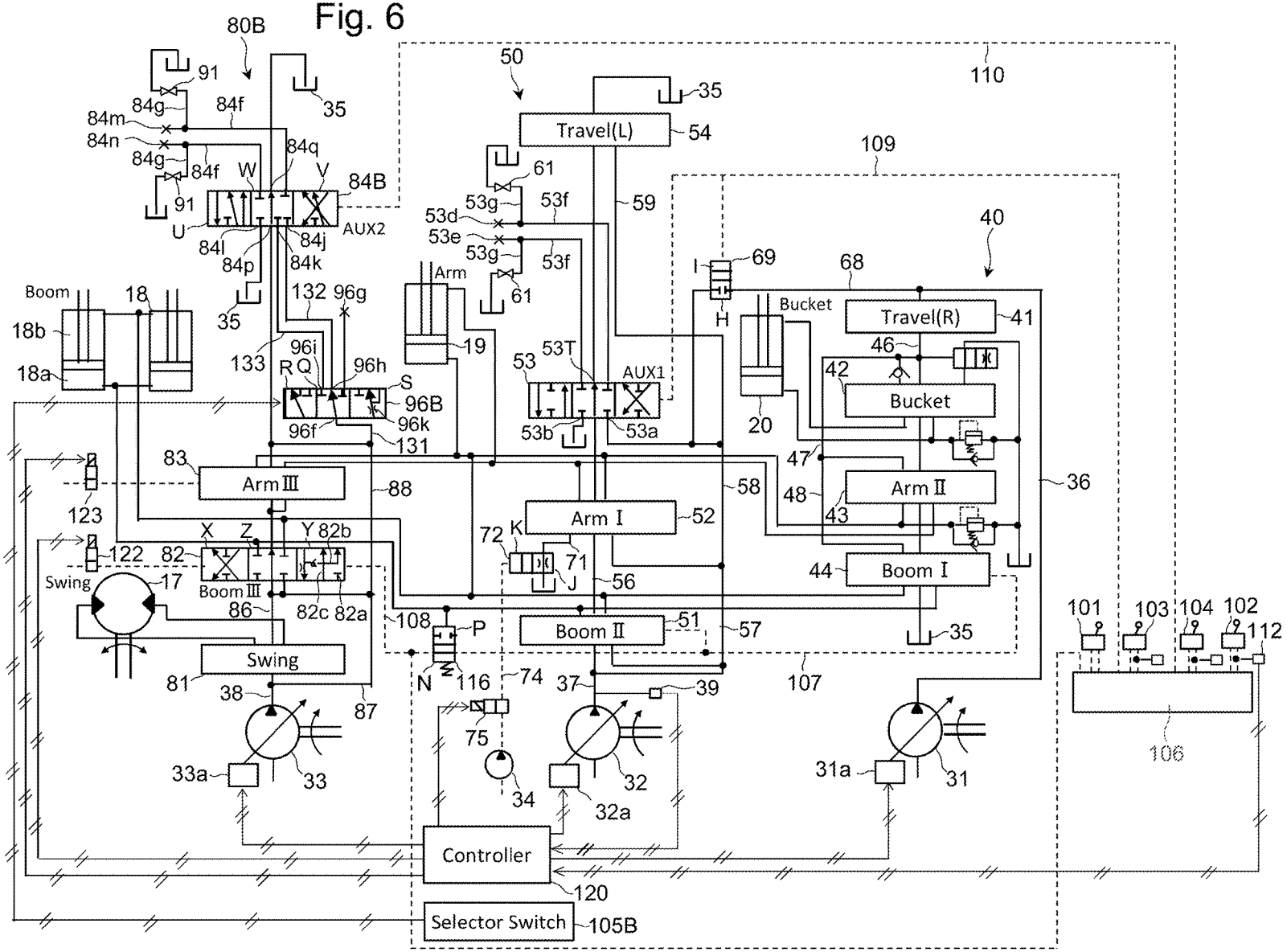
FIG. 6 is a hydraulic circuit diagram illustrating a hydraulic drive system for a work machine according to a second embodiment of the present invention in a state where a special attachment is not attached thereto.
Figure 7:
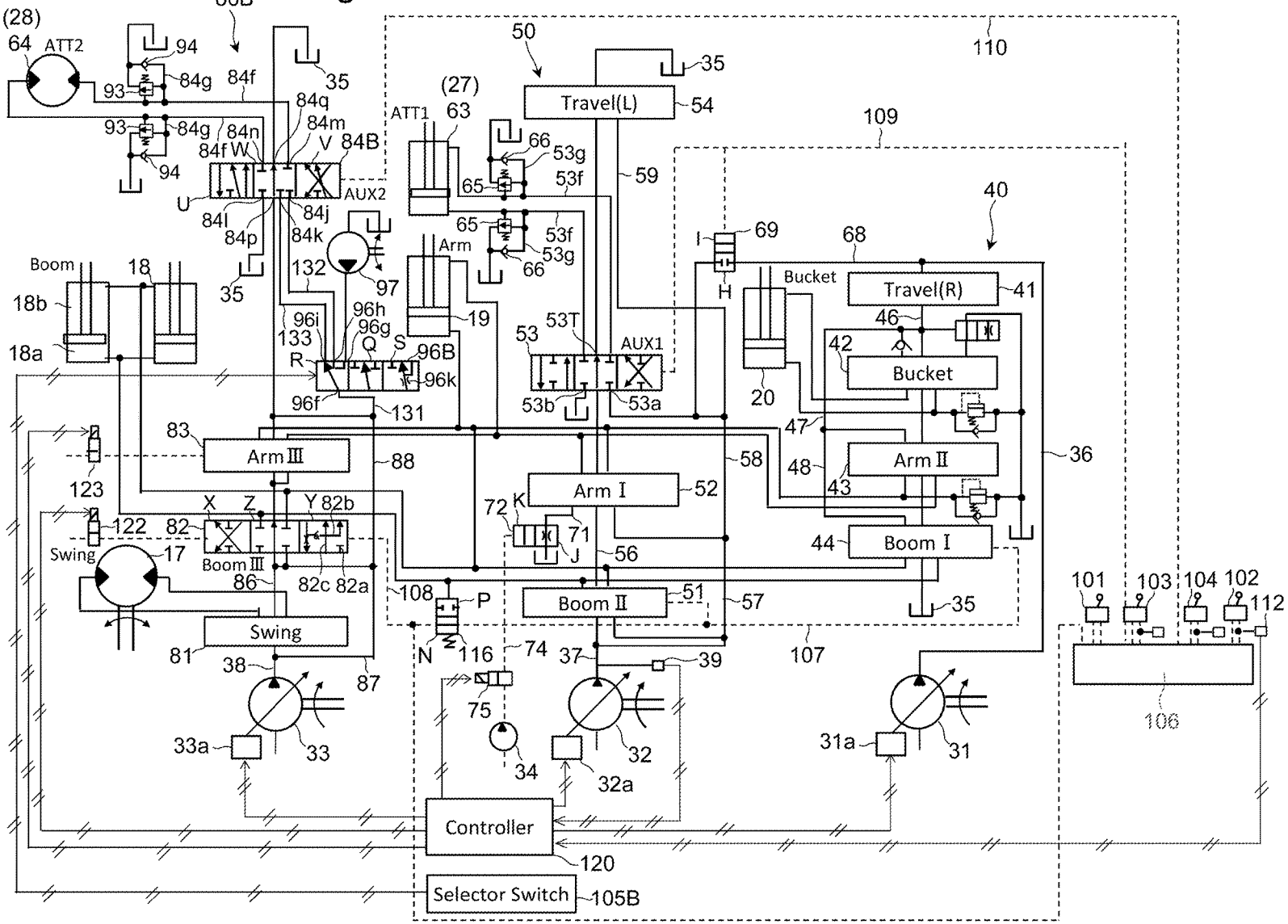
FIG. 7 is a hydraulic circuit diagram illustrating the hydraulic drive system for a work machine according to the second embodiment of the present invention in a state where a special attachment is attached thereto.

Next, FIG. 6 and FIG. 7 are used to explain a hydraulic drive system for a work machine according to a second embodiment of the present invention. FIG. 6 is a hydraulic circuit diagram illustrating the hydraulic drive system for a work machine according to the second embodiment of the present invention in a state where a special attachment is not attached thereto, and FIG. 7 is a hydraulic circuit diagram illustrating the hydraulic drive system for a work machine according to the second embodiment of the present invention in a state where a special attachment is attached thereto. Note that in FIG. 6 and FIG. 7, those with the same reference characters as reference characters illustrated in FIG. 1 to FIG. 5 are similar portions, and so detailed explanations thereof are omitted.

The hydraulic drive system for a work machine according to the second embodiment of the present invention illustrated in FIG. 6 and FIG. 7 is a system in which the hydraulic fluid source of the additional second special hydraulic actuator 64 that drives a special attachment is switched to any one of the third hydraulic pump 33, the additional hydraulic pump 97, and both the additional hydraulic pump 97 and the third hydraulic pump 33. Major differences of the second embodiment from the first embodiment are as follows. Firstly, a first selector valve 96B is configured not of a four-port two-position selector valve, but of a four-port three-position selector valve. Secondly, a second auxiliary directional control valve 84B is configured not of a six-port three-position control valve, but of a seven-port three-position control valve. Thirdly, the first selector valve 96B is arranged not on the third center bypass line 86, but on a hydraulic line that branches off from the seventh parallel hydraulic line 88, and is connected to the second auxiliary directional control valve 84B. Fourthly, a selector switch 105B is configured to have three instruction positions corresponding to the three switch positions of the first selector valve 96B.

The first selector valve 96B is configured to be switched between a first switch position Q for using only the third hydraulic pump 33 as the hydraulic fluid source of the second special hydraulic actuator 64, a second switch position R for using only the additional hydraulic pump 97 as the hydraulic fluid source of the second special hydraulic actuator 64, and a third switch position S for using both of the third hydraulic pump 33 and the additional hydraulic pump 97 as the hydraulic fluid source of the second special hydraulic actuator 64. The first selector valve 96B has: a first inlet port 96*f* that is supplied with the hydraulic fluid from the third hydraulic pump 33; a second inlet port 96*g* that is connectable with the additional hydraulic pump 97; and a first connection port 96*h* and a second connection port 96*i* that communicate with the second auxiliary directional control valve 84B.

The first selector valve 96B is configured such that when the first selector valve 96B is at the first switch position Q, while the first inlet port 96*f* and the first connection port 96*h* communicate with each other, the second inlet port 96*g* and the second connection port 96*i* are closed. When the first selector valve 96B is at the first switch position Q, the first selector valve 96B guides, to the second auxiliary directional control valve 84, the hydraulic fluid supplied from the third hydraulic pump 33. The first selector valve 96B is configured such that when the first selector valve 96B is at the second switch position R, the first inlet port 96*f* and the second connection port 96*i* communicate with each other, and the second inlet port 96*g* and the first connection port 96*h* communicate with each other. When the first selector valve 96B is at the second switch position R, the first selector valve 96B guides, to the second auxiliary directional control valve 84, the hydraulic fluid supplied from the additional hydraulic pump 97, and guides, to the second auxiliary directional control valve 84, the hydraulic fluid supplied from the third hydraulic pump 33. The first selector valve 96B is configured such that when the first selector valve 96B is at the third switch position S, while the first inlet port 96*f*, the second inlet port 96*g* and the first connection port 96*h* communicate with each other, the second connection port 96*i* is closed. A restrictor 96*k* is provided at a portion on a communication line that establishes communication between the first inlet port 96*f* and the first connection port 96*h*, the restrictor 96*k* being provided upstream of a portion where the communication line is connected with the side on which the second inlet port 96*g* is located. When the first selector valve 96B is at the third switch position S, the first selector valve 96B merges the hydraulic fluid supplied from the third hydraulic pump 33 and the hydraulic fluid supplied from the additional hydraulic pump 97 to guide the merged flow to the second auxiliary directional control valve 84.

The second auxiliary directional control valve 84B is configured to be switched between a first switch position U for driving the second special hydraulic actuator 64 in one direction, a second switch position V for driving the second special hydraulic actuator 64 in another direction, and a neutral position W for interrupting the supply of the hydraulic fluid to the second special hydraulic actuator 64 to guide, to the hydraulic-working-fluid tank 35, the hydraulic fluid supplied from the third hydraulic pump 33 via the third center bypass line 86. The second auxiliary directional control valve 84B has: a first inlet port 84*j* and a second inlet port 84*k* that are supplied with the hydraulic fluid; a tank port 84*l* that communicates with the hydraulic-working-fluid tank 35; two connection ports 84*m* and 84*n* that is connectable with the second special hydraulic actuator 64; and two center ports 84*p* and 84*q* that communicate with each other when the second auxiliary directional control valve 84B is at the neutral position. The second auxiliary directional control valve 84B is configured such that when the second auxiliary directional control valve 84B is at the first switch position U, while the first inlet port 84*j* and the connection port 84*m* communicate with each other, the second inlet port 84*k* and the center port 84*q* communicate with each other, and the tank port 84*l* and the connection port 84*n* communicate with each other, the center port 84*p* is closed. The second auxiliary directional control valve 84B is configured such that when the second auxiliary directional control valve 84B is at the second switch position V, while the first inlet port 84*j* and the connection port 84*n* communicate with each other, the second inlet port 84*k* and the center port 84*q* communicate with each other, and the tank port 84*l* and the connection port 84*m* communicate with each other, the center port 84*p* is closed. The second auxiliary directional control valve 84B is configured such that when the second auxiliary directional control valve 84B is at the neutral position W, while the center ports 84*p* and 84*q* communicate with each other, the first inlet port 84*j*, the second inlet port 84*k*, the tank port 84*l* and the connection ports 84*m* and 84*n* are closed.

A branch hydraulic line 131 that branches off from the seventh parallel hydraulic line 88 is connected to the first inlet port 96*f* of the first selector valve 96B. The first connection port 96*h* and second connection port 96*i* of the first selector valve 96B are connected to the first inlet port 84*j* and second inlet port 84*k* of the second auxiliary directional control valve 84B via a first connection hydraulic line 132 and a second connection hydraulic line 133, respectively.

Note that, in the present embodiment, since the first selector valve 96B includes the restrictor 96*k* at the third switch position S, the variable restrictor 89 in the first embodiment is removed.

The selector switch 105B gives an instruction for the switch position of the first selector valve 96 by being switched between a standard use position for giving an instruction for not using an additional hydraulic pump, a first special use position for giving an instruction for using only the additional hydraulic pump 97 as the hydraulic fluid source of the additional second special hydraulic actuator 64, and a second special use position for giving an instruction for using both of the third hydraulic pump 33 and the additional hydraulic pump 97 as the hydraulic fluid source of the additional second special hydraulic actuator 64.

Next, FIG. 6 and FIG. 7 are used to explain operation of the hydraulic drive system for a work machine according to the second embodiment of the present invention. In the case explained firstly, a special attachment that is not required to have favorable operability for combined operation is attached instead of or in addition to the bucket 13, which is the standard attachment, and a retrofit additional hydraulic pump is not used.

The selector switch 105B is set to the normal use position. An instruction signal from the selector switch 105B keeps the first selector valve 96B at the first switch position Q.

In this state, single operation of the special attachment is performed. When the second auxiliary operation device 104 is operated, the second auxiliary directional control valve 84B is switched to a switch position according to the operation direction. Thereby, the hydraulic fluid delivered from the third hydraulic pump 33 is supplied to the second special hydraulic actuator 64 via the first selector valve 96B and the second auxiliary directional control valve 84B, and the special attachment is driven by the second special hydraulic actuator 64.

Note that also in a case where the front work implement 4 is configured of the boom 11, the arm 12 and the bucket 13, and a retrofit additional hydraulic pump is not used, the first selector valve 96B is switched to the first switch position Q. Since the second auxiliary operation device 104 is not operated, and the second auxiliary directional control valve 84B is kept at the neutral position in this case, the hydraulic fluid supplied from the third hydraulic pump 33 to the second auxiliary directional control valve 84B is guided to the hydraulic-working-fluid tank 35.

In the case explained secondly, the swing-type grapple 22 is attached instead of the bucket 13, and the retrofit additional hydraulic pump 97 is used. The grapple-swing hydraulic motor 28 is connected to the connection ports 84*m* and 84*n* of the second auxiliary directional control valve 84B. Furthermore, the additional hydraulic pump 97 is connected to the second inlet port 96*g* of the first selector valve 96B.

An operator can switch the selector switch 105B to the first special use position for giving an instruction for singly using the additional hydraulic pump 97 as the hydraulic fluid source of the second special hydraulic actuator 64, for example. In this case, an instruction signal from the selector switch 105B switches the first selector valve 96B to the second switch position R. Thereby, communication is established between the additional hydraulic pump 97 and the first inlet port 84*j* of the second auxiliary directional control valve 84B. In addition, communication is established between the third hydraulic pump 33 and the second inlet port 84*k* of the second auxiliary directional control valve 84B. Since the second inlet port 84*k* of the second auxiliary directional control valve 84B communicates with the center port 84*q* no matter whether the second auxiliary directional control valve 84B is at the first switch position U or at the second switch position V, the hydraulic fluid supplied from the third hydraulic pump 33 to the second auxiliary directional control valve 84B via the first selector valve 96B is guided to the hydraulic-working-fluid tank. That is, the hydraulic fluid source of the grapple-swing hydraulic motor 28 connected to the second auxiliary directional control valve 84B is now the additional hydraulic pump 97. On the other hand, the hydraulic fluid source of the swing hydraulic motor 17, the boom cylinder 18 and the arm cylinder 19 respectively connected to the swing directional control valve 81, the third boom directional control valve 82 and the third arm directional control valve 83 is the third hydraulic pump 33.

In this state, combined operation of swing operation of the upper swing structure 3, operation of the boom 11 and the arm 12, and swing operation of the grapple 22 is performed. The hydraulic fluid delivered by the third hydraulic pump 33 is supplied to the swing hydraulic motor 17 via the swing directional control valve 81 or to the boom cylinder 18 via the third boom directional control valve 82. On the other hand, the hydraulic fluid delivered by the additional hydraulic pump 97 is supplied to the grapple-swing hydraulic motor 28 via the first selector valve 96B and the second auxiliary directional control valve 84B, and the driving of the grapple-swing hydraulic motor 28 swings the fork 26 of the grapple 22 right or left. In this manner, the hydraulic fluid source of the grapple-swing hydraulic motor 28 is the additional hydraulic pump 97, and is not the third hydraulic pump 33, which is the hydraulic fluid source shared by the swing hydraulic motor 17, the boom cylinder 18 and the arm cylinder 19. Accordingly, swing operation of the grapple 22 is not affected by any operation of swing operation of the upper swing structure 3, boom operation, and arm operation. Accordingly, favorable operability for combined operation of the grapple 22, the upper swing structure 3, the boom 11 and the arm 12 can be ensured.

In this manner, in the present embodiment, by switching the first selector valve 96B to the second switch position R in a case where a special attachment is attached and the retrofit additional hydraulic pump 97 is used, the hydraulic fluid source of the second special hydraulic actuator 64 that drives the special attachment can be switched not to the third hydraulic pump 33 that are shared by the other hydraulic actuators 17, 18 and 19, but to the additional hydraulic pump 97. That is, the second special hydraulic actuator 64 can singly use the additional hydraulic pump 97 as a hydraulic fluid source. Accordingly, operability for combined operation of the special attachment driven by the second special hydraulic actuator 64 improves.

In addition, an operator can also switch the selector switch 105B to the second special use position for giving an instruction for using both the third hydraulic pump 33 and the additional hydraulic pump 97 as the hydraulic fluid source of the additional second special hydraulic actuator 64. In this case, an instruction signal from the selector switch 105B switches the first selector valve 96B to the third switch position S. Thereby, communication is established between the first inlet port 84*j* of the second auxiliary directional control valve 84B, and the third hydraulic pump 33 and the additional hydraulic pump 97. That is, the hydraulic fluid source of the grapple-swing hydraulic motor 28 is switched to the additional hydraulic pump 97 and the third hydraulic pump 33. On the other hand, the hydraulic fluid source of the swing hydraulic motor 17, the boom cylinder 18 and the arm cylinder 19 is still the third hydraulic pump 33.

In this state, combined operation of swing operation of the upper swing structure 3, operation of the boom 11 and the arm 12, and swing operation of the grapple 22 is performed. The hydraulic fluid delivered from the third hydraulic pump 33 is supplied to the swing hydraulic motor 17 via the swing directional control valve 81, to the boom cylinder 18 via the third boom directional control valve 82, or to the grapple-swing hydraulic motor 28 via the first selector valve 96B and the second auxiliary directional control valve 84B. On the other hand, the hydraulic fluid delivered from the additional hydraulic pump 97 is supplied to the grapple-swing hydraulic motor 28 via the first selector valve 96B and the second auxiliary directional control valve 84B. That is, the grapple-swing hydraulic motor 28 is supplied with the hydraulic fluid from both the additional hydraulic pump 97 and the third hydraulic pump 33. In this manner, as the hydraulic fluid source of the grapple-swing hydraulic motor 28, the additional hydraulic pump 97 is used, in addition to the third hydraulic pump 33 shared by the swing hydraulic motor 17, the boom cylinder 18 and the arm cylinder 19.

Accordingly, swing operation of the grapple 22 is less likely to be affected by swing operation of the upper swing structure 3, boom operation and arm operation, and favorable operability for the combined operation of the grapple 22, the upper swing structure 3, the boom and the arm 12 can be ensured. In addition, since, in addition to the hydraulic fluid from the additional hydraulic pump 97, the grapple-swing hydraulic motor 28 is supplied with the hydraulic fluid from the third hydraulic pump 33 in accordance with the operation load pressure, the amount of supply of the hydraulic fluid to the grapple-swing hydraulic motor 28 increases as compared to a case where only the additional hydraulic pump 97 is used as the hydraulic fluid source of the grapple-swing hydraulic motor 28, and the driving speed of a special actuator can be improved.

In this manner, in the present embodiment, by switching the first selector valve 96B to the third switch position S in a case where a special attachment is attached and the retrofit additional hydraulic pump 97 is used, both the additional hydraulic pump 97 and the third hydraulic pump 33 can be used as the hydraulic fluid source of the second special hydraulic actuator 64. Accordingly, operability for combined operation of the special attachment driven by the second special hydraulic actuator 64 improves.

According to the hydraulic drive system for a work machine according to the second embodiment of the present invention mentioned above, effects similar to those in the first embodiment mentioned before can be attained.

In addition, according to the second embodiment mentioned above, the first selector valve 96B is configured to be switched among the first switch position Q for using only the third hydraulic pump 33 as the hydraulic fluid source of the second special hydraulic actuator 64 that drives a special attachment, the second switch position R for using only the additional hydraulic pump 97 as the hydraulic fluid source of the second special hydraulic actuator 64, and the third switch position S for combine use of the third hydraulic pump 33 and the additional hydraulic pump 97 as the hydraulic fluid source of the second special hydraulic actuator 64. Accordingly, the hydraulic fluid source of the second special hydraulic actuator 64 can be switched to an appropriate hydraulic fluid source in accordance with whether or not a special attachment is attached and/or requirements in terms of operability of the special attachment.

Furthermore, according to the second embodiment mentioned above, in the hydraulic drive system equipped in advance with the second auxiliary directional control valve 84B that is connectable with the additional second special hydraulic actuator 64 for driving a special attachment, the hydraulic fluid source of the second special hydraulic actuator 64 can be switched by connecting the three-position first selector valve 96B to the third hydraulic pump 33 at the upstream of the second auxiliary directional control valve 84. Accordingly, improvement in operability for combined operation of a special attachment can be realized with a simple configuration.

Other Embodiments

Note that although the first and second embodiments mentioned above are explained by using as an example the hydraulic excavator 1 as a work machine to which the present invention is applied, the present invention can be applied widely to work machines that include a plurality of work elements, and a plurality of hydraulic actuators that drive the work elements, and are required to allow combined operation.

In addition, the present invention is not limited to the embodiments mentioned above, but includes various modification examples. The embodiments described above are explained in detail in order to explain the present invention in an easy-to-understand manner, and the present invention is not necessarily limited to embodiments including all the configurations explained. For example, some of the configurations of an embodiment can be replaced with configurations of another embodiment, and configurations of an embodiment can also be added to the configurations of another embodiment. In addition, some of the configurations of individual embodiments can also have other additional configurations, removed or replaced.

For example, the first embodiment, and the modification example thereof mentioned above illustrate example configurations in which in the third control valve group 80, the swing directional control valve 81, the third boom directional control valve 82 and the second auxiliary directional control valve 84 are connected in parallel with each other via the sixth parallel hydraulic line 87 and the seventh parallel hydraulic line 88. However, in another possible configuration, the second auxiliary directional control valve 84 is not connected in parallel with the swing directional control valve 81 and the third boom directional control valve 82, but is connected in tandem at the downstream of the swing directional control valve 81 and the third boom directional control valve 82. That is, the seventh parallel hydraulic line 88 is removed in another possible configuration.

In addition, the first and second embodiments mentioned above illustrate example configurations in which the first selector valves 96 and 96B are configured of selector valves of solenoid-type, and the modification example of the first embodiment mentioned above illustrates an example configuration in which the first selector valve 96A is configured of a selector valve of hydraulic pilot-type. However, the first selector valves are switched manually in other possible configurations. In this case, the selector switches are replaced with switch levers mechanically connected to the first selector valves, or the like.

In addition, the first and second embodiments mentioned above illustrate example configurations in which instruction signals of the selector switches 105 and 105B are directly output to the first selector valves 96 and 96B, which are selector valves of solenoid-type, and operation of switching the first selector valves 96 and 96B is performed. In contrast to this, in another possible configuration, an instruction signal of a selector switch is input to the controller 120, and the switch position of the first selector valve is switched via the controller 120.

In addition, although the embodiments mentioned above illustrate example configurations in which the auxiliary merge valve 69 is switched by the pilot pressure of the first auxiliary operation device 103, the auxiliary merge valve 69 is switched by operating an additionally provided switch in another possible configuration.

DESCRIPTION OF REFERENCE CHARACTERS

1: Hydraulic excavator (work machine)
3: Upper swing structure (swing structure)
11: Boom
12: Arm
17: Swing hydraulic motor (third hydraulic actuator)
18: Boom cylinder (first hydraulic actuator)
19: Arm cylinder (second hydraulic actuator)
22: Grapple (special attachment)
31: First hydraulic pump
32: Second hydraulic pump
33: Third hydraulic pump
43: Second arm directional control valve (second-hydraulic-actuator second directional control valve)

44: First boom directional control valve (first-hydraulic-actuator first directional control valve)
51: Second boom directional control valve (first-hydraulic-actuator second directional control valve)
52: First arm directional control valve (second-hydraulic-actuator first directional control valve)
53: First auxiliary directional control valve
63: First special hydraulic actuator
64: Second special hydraulic actuator
81: Swing directional control valve (third-hydraulic-actuator directional control valve)
82: Third boom directional control valve (first-hydraulic-actuator third directional control valve)
84, 84B: Second auxiliary directional control valve
88: Seventh parallel hydraulic line (parallel hydraulic line)
89: Variable restrictor
96, 96A, 96B: First selector valve (selector valve)
97: Additional hydraulic pump

The invention claimed is:

1. A hydraulic drive system for a work machine, the hydraulic drive system comprising:

a first hydraulic pump and a second hydraulic pump that supply a hydraulic fluid at least to a first hydraulic actuator and a second hydraulic actuator;

a third hydraulic pump that supplies the hydraulic fluid at least to a third hydraulic actuator and the first hydraulic actuator;

a first-hydraulic-actuator first directional control valve that controls a flow of the hydraulic fluid supplied from the first hydraulic pump to the first hydraulic actuator;

a second-hydraulic-actuator second directional control valve that controls a flow of the hydraulic fluid supplied from the first hydraulic pump to the second hydraulic actuator;

a first-hydraulic-actuator second directional control valve that controls a flow of the hydraulic fluid supplied from the second hydraulic pump to the first hydraulic actuator;

a second-hydraulic-actuator first directional control valve that controls a flow of the hydraulic fluid supplied from the second hydraulic pump to the second hydraulic actuator;

a first auxiliary directional control valve that is connectable with a first special hydraulic actuator for driving an additionally attachable special attachment, and is configured to control a flow of the hydraulic fluid supplied from the second hydraulic pump to the first special hydraulic actuator;

a third-hydraulic-actuator directional control valve that controls a flow of the hydraulic fluid supplied from the third hydraulic pump to the third hydraulic actuator; and a first-hydraulic-actuator third directional control valve that controls a flow of the hydraulic fluid supplied from the third hydraulic pump to the first hydraulic actuator, the first-hydraulic-actuator first directional control valve and the second-hydraulic-actuator second directional control valve being connected, in parallel with each other, to the first hydraulic pump, the first-hydraulic-actuator second directional control valve, the second-hydraulic-actuator first directional control valve and the first auxiliary directional control valve being connected, in parallel with each other, to the second hydraulic pump, the third-hydraulic-actuator directional control valve and the first-hydraulic-actuator third directional control valve being connected, in parallel with each other, to the third hydraulic pump, wherein the hydraulic drive system includes:

a second auxiliary directional control valve that is connected to the third hydraulic pump, is connectable with a second special hydraulic actuator for driving the special attachment or an additionally attachable special attachment different from the special attachment, and is configured to control a flow of the hydraulic fluid to the second special hydraulic actuator;

a selector valve that is connected to the third hydraulic pump upstream of the second auxiliary directional control valve, and is connectable with a retrofit additional hydraulic pump, the selector valve being configured to switch a hydraulic fluid source of the second special hydraulic actuator connected to the second auxiliary directional control valve at least between the third hydraulic pump and the additional hydraulic pump, and wherein the selector valve is a two-position selector valve that is switched between a first switch position for guiding the hydraulic fluid supplied from the third hydraulic pump to the second auxiliary directional control valve and a second switch position for guiding the hydraulic fluid supplied from the additional hydraulic pump to the second auxiliary directional control valve.

2. The hydraulic drive system for a work machine, according to claim 1, wherein the second auxiliary directional control valve is connected, in parallel with the third-hydraulic-actuator directional control valve and the first-hydraulic-actuator third directional control valve, to the third hydraulic pump via a parallel hydraulic line, a downstream end portion of the parallel hydraulic line is connected to a hydraulic line between the selector valve and the second auxiliary directional control valve, and a variable restrictor is disposed on the parallel hydraulic line.

3. The hydraulic drive system for a work machine, according to claim 1, wherein the work machine is a hydraulic excavator including at least a swingable swing structure, a boom attached to the swing structure in a raiseable and lowerable manner, and an arm pivotably attached to a tip of the boom, the first hydraulic actuator is a boom cylinder that drives the boom, the second hydraulic actuator is an arm cylinder that drives the arm, and the third hydraulic actuator is a swing hydraulic motor that swing-drives the swing structure.

4. A hydraulic drive system for a work machine, the hydraulic drive system comprising:

a first hydraulic pump and a second hydraulic pump that supply a hydraulic fluid at least to a first hydraulic actuator and a second hydraulic actuator;

a third hydraulic pump that supplies the hydraulic fluid at least to a third hydraulic actuator and the first hydraulic actuator;

a first-hydraulic-actuator first directional control valve that controls a flow of the hydraulic fluid supplied from the first hydraulic pump to the first hydraulic actuator;

a second-hydraulic-actuator second directional control valve that controls a flow of the hydraulic fluid supplied from the first hydraulic pump to the second hydraulic actuator;

a first-hydraulic-actuator second directional control valve that controls a flow of the hydraulic fluid supplied from the second hydraulic pump to the first hydraulic actuator;

a second-hydraulic-actuator first directional control valve that controls a flow of the hydraulic fluid supplied from the second hydraulic pump to the second hydraulic actuator;

a first auxiliary directional control valve that is connectable with a first special hydraulic actuator for driving an additionally attachable special attachment and is configured to control a flow of the hydraulic fluid supplied from the second hydraulic pump to the first special hydraulic actuator;

a third-hydraulic-actuator directional control valve that controls a flow of the hydraulic fluid supplied from the third hydraulic pump to the third hydraulic actuator; and a first-hydraulic-actuator third directional control valve that controls a flow of the hydraulic fluid supplied from the third hydraulic pump to the first hydraulic actuator, the first-hydraulic-actuator first directional control valve and the second-hydraulic-actuator second directional control valve being connected, in parallel with each other, to the first hydraulic pump, the first-hydraulic-actuator second directional control valve, the second-hydraulic-actuator first directional control valve and the first auxiliary directional control valve being connected, in parallel with each other, to the second hydraulic pump, the third-hydraulic-actuator directional control valve and the first-hydraulic-actuator third directional control valve being connected, in parallel with each other, to the third hydraulic pump, wherein the hydraulic drive system includes:

a second auxiliary directional control valve that is connected to the third hydraulic pump, is connectable with a second special hydraulic actuator for driving the special attachment or an additionally attachable special attachment different from the special attachment, and is configured to control a flow of the hydraulic fluid to the second special hydraulic actuator;

a selector valve that is connected to the third hydraulic pump upstream of the second auxiliary directional control valve, and is connectable with a retrofit additional hydraulic pump, the selector valve being configured to switch a hydraulic fluid source of the second special hydraulic actuator connected to the second auxiliary directional control valve at least between the third hydraulic pump and the additional hydraulic pump, and wherein the selector valve is a three-position selector valve that is switched between a first switch position for guiding the hydraulic fluid supplied from the third hydraulic pump to the second auxiliary directional control valve, a second switch position for guiding the hydraulic fluid supplied from the additional hydraulic pump to the second auxiliary directional control valve, and a third switch position for merging the hydraulic fluid supplied from the third hydraulic pump and the hydraulic fluid supplied from the additional hydraulic pump to be guided to the second auxiliary directional control valve.

5. The hydraulic drive system for a work machine, according to claim 4, wherein the work machine is a hydraulic excavator including at least a swingable swing structure, a boom attached to the swing structure in a raiseable and lowerable manner, and an arm pivotably attached to a tip of the boom, the first hydraulic actuator is a boom cylinder that drives the boom, the second hydraulic actuator is an arm cylinder that drives the arm, and the third hydraulic actuator is a swing hydraulic motor that swing-drives the swing structure.

6. A hydraulic drive system for a work machine, the hydraulic drive system comprising:

a first hydraulic pump and a second hydraulic pump that supply a hydraulic fluid at least to a first hydraulic actuator and a second hydraulic actuator;

a third hydraulic pump that supplies the hydraulic fluid at least to a third hydraulic actuator and the first hydraulic actuator;

a first-hydraulic-actuator first directional control valve that controls a flow of the hydraulic fluid supplied from the first hydraulic pump to the first hydraulic actuator;

a second-hydraulic-actuator second directional control valve that controls a flow of the hydraulic fluid supplied from the first hydraulic pump to the second hydraulic actuator;

a first-hydraulic-actuator second directional control valve that controls a flow of the hydraulic fluid supplied from the second hydraulic pump to the first hydraulic actuator;

a second-hydraulic-actuator first directional control valve that controls a flow of the hydraulic fluid supplied from the second hydraulic pump to the second hydraulic actuator;

a first auxiliary directional control valve that is connectable with a first special hydraulic actuator for driving an additionally attachable special attachment, and is configured to control a flow of the hydraulic fluid supplied from the second hydraulic pump to the first special hydraulic actuator;

a third-hydraulic-actuator directional control valve that controls a flow of the hydraulic fluid supplied from the third hydraulic pump to the third hydraulic actuator; and a first-hydraulic-actuator third directional control valve that controls a flow of the hydraulic fluid supplied from the third hydraulic pump to the first hydraulic actuator, the first-hydraulic-actuator first directional control valve and the second-hydraulic-actuator second directional control valve being connected, in parallel with each other, to the first hydraulic pump, the first-hydraulic-actuator second directional control valve, the second-hydraulic-actuator first directional control valve and the first auxiliary directional control valve being connected, in parallel with each other, to the second hydraulic pump, the third-hydraulic-actuator directional control valve and the first-hydraulic-actuator third directional control valve being connected, in parallel with each other, to the third hydraulic pump, wherein the hydraulic drive system includes:

a second auxiliary directional control valve that is connected to the third hydraulic pump, is connectable with a second special hydraulic actuator for driving the special attachment or an additionally attachable special attachment different from the special attachment, and is configured to control a flow of the hydraulic fluid to the second special hydraulic actuator;

a selector valve that is connected to the third hydraulic pump upstream of the second auxiliary directional control valve, and is connectable with a retrofit additional hydraulic pump, and the selector valve being configured to switch a hydraulic fluid source of the second special hydraulic actuator connected to the second auxiliary directional control valve at least between the third hydraulic pump and the additional hydraulic pump, wherein the selector valve is a solenoid-type selector valve.

7. The hydraulic drive system for a work machine, according to claim 6, wherein the work machine is a hydraulic excavator including at least a swingable swing structure, a boom attached to the swing structure in a raiseable and lowerable manner, and an arm pivotably attached to a tip of the boom, the first hydraulic actuator is a boom cylinder that drives the boom, the second hydraulic actuator is an arm cylinder that drives the arm, and the third hydraulic actuator is a swing hydraulic motor that swing-drives the swing structure.

* * * * *